US011654704B2

(12) United States Patent
Hanawa et al.

(10) Patent No.: US 11,654,704 B2
(45) Date of Patent: May 23, 2023

(54) RECORDING APPARATUS

(71) Applicant: SEIKO EPSON CORPORATION, Tokyo (JP)

(72) Inventors: Keita Hanawa, Matsumoto (JP); Katsunari Kumagai, Okaya (JP); Kensuke Tamai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/495,482

(22) Filed: Oct. 6, 2021

(65) Prior Publication Data

US 2022/0024233 A1 Jan. 27, 2022

Related U.S. Application Data

(63) Continuation of application No. 16/799,397, filed on Feb. 24, 2020, now Pat. No. 11,167,575.

(30) Foreign Application Priority Data

Feb. 27, 2019 (JP) ..... JP2019-033848
Oct. 4, 2019 (JP) ..... JP2019-183590

(51) Int. Cl.
*B41J 25/308* (2006.01)

(52) U.S. Cl.
CPC ..... *B41J 25/308* (2013.01)

(58) Field of Classification Search
CPC ... B41J 25/308; B41J 25/3082; B41J 25/3086
See application file for complete search history.

(56) References Cited

U.S. PATENT DOCUMENTS

2003/0227505 A1* 12/2003 Tanaka ..... B41J 2/16511 347/29
2007/0122220 A1 5/2007 Tamaki et al.
2014/0009518 A1 1/2014 Kumagai et al.
2014/0009519 A1* 1/2014 Kumagai ..... B41J 25/3082 347/8

FOREIGN PATENT DOCUMENTS

JP 2007-144766 A 6/2007
JP 2014-014937 A 1/2014
JP 2014-014938 A 1/2014
JP 2014-195926 A 10/2016

* cited by examiner

*Primary Examiner* — Scott A Richmond
(74) *Attorney, Agent, or Firm* — Workman Nydegger

(57) ABSTRACT

A printer includes a gap adjustment unit that displaces a carriage in a Z-axis direction in which a gap changes. The gap adjustment unit has a sliding member that moves in a width direction integrally with the carriage, and a cam member that is interposed between the carriage and the sliding member and has a stepped portion in which a maintenance surface that maintains a position of the carriage in the Z-axis direction and an adjustment surface that changes the position of the carriage in the Z-axis direction are alternately arranged in the width direction. The gap adjustment unit is configured such that the cam member slides in the width direction with respect to the carriage and the sliding member to change the gap. The gap adjustment unit includes a buffer unit that decreases a displacement speed of the carriage in the Z-axis direction when the gap is reduced.

10 Claims, 21 Drawing Sheets

RECORDING APPARATUS

The present application is a Continuation of U.S. patent application Ser. No. 16/799,397, filed Feb. 24, 2020, which claims priority from JP Application Serial Number 2019-033848, filed Feb. 27, 2019, and JP Application Serial Number 2019-183590, filed Oct. 4, 2019, the disclosures of which are hereby incorporated by reference herein in their entirety.

BACKGROUND

1. Technical Field

The present disclosure relates to a recording apparatus that performs recording on a medium.

2. Related Art

A recording apparatus represented by a printer is provided with a recording head that is mounted on a carriage reciprocating in a width direction of a medium and ejects an ink, which is a liquid, toward the medium, and is configured to perform recording on the medium by ejecting the ink while moving the recording head in the width direction. The medium is sent toward the recording head by a transport unit such as a transport roller.

The medium transported by the transport unit is supported from the lower side by a medium supporting member provided at a position facing the recording head. Accordingly, a paper gap, which is a distance between a recording surface of the medium and the recording head, is defined. In the following, the paper gap may be abbreviated as PG.

When a distance between the recording head and the medium supporting member is fixed, the PG is changed according to the thickness of the medium. Since the change in the PG affects image quality, there is a possibility that the image quality may deteriorate due to a difference in the thickness of the medium. In order to suppress influence on the image quality due to the difference in the thickness of the medium, for example, JP-A-2007-144766 discloses a recording apparatus including a gap adjustment member that adjusts the PG by changing the height of the recording head according to the thickness of the medium.

The gap adjustment member disclosed in JP-A-2007-144766 includes a stepped portion which is slidable in a width direction and of which the height is changed in a stepwise manner in a slide direction. A support member that can be displaced in a height direction is disposed to come into contact with the stepped portion. The support member is provided on the carriage. When the support member is displaced in the height direction, the heights of the carriage and the recording head mounted on the carriage are also changed. When the gap adjustment member is slid, the support member is displaced in the height direction along the stepped portion, and the height of the recording head is also changed.

As in JP-A-2007-144766, when a height of a recording head is changed by displacing a support member along a stepped portion of a gap adjustment member, in a case in which the support member moves from a high step to a low step of the stepped portion, the carriage may fall by a height corresponding to a step difference due to a self-weight thereof, and thus a loud sound may be generated.

SUMMARY

According to an aspect of the present disclosure, there is provided a recording apparatus including a recording head that performs recording on a medium that is transported, a carriage that has the recording head mounted thereon and is movable in a width direction intersecting a transport direction of the medium, a guide member that extends in the width direction and guides the carriage, and a gap adjustment unit that displaces the carriage in a first axis direction to change a gap between the recording head and a support surface. The gap adjustment unit has a sliding member that moves in the width direction integrally with the carriage while the sliding member slides with respect to the guide member, and a cam member that is interposed between the carriage and the sliding member and has a stepped portion in which a maintenance surface that maintains a position of the carriage in the first axis direction and an adjustment surface that changes the position of the carriage in the first axis direction are alternately arranged in the width direction. The gap adjustment unit is configured such that the cam member slides in the width direction with respect to the carriage and the sliding member to change the gap. The gap adjustment unit includes a buffer unit that decreases a displacement speed of the carriage in the first axis direction when the gap is reduced.

DESCRIPTION OF EXEMPLARY EMBODIMENTS

Figure 1:
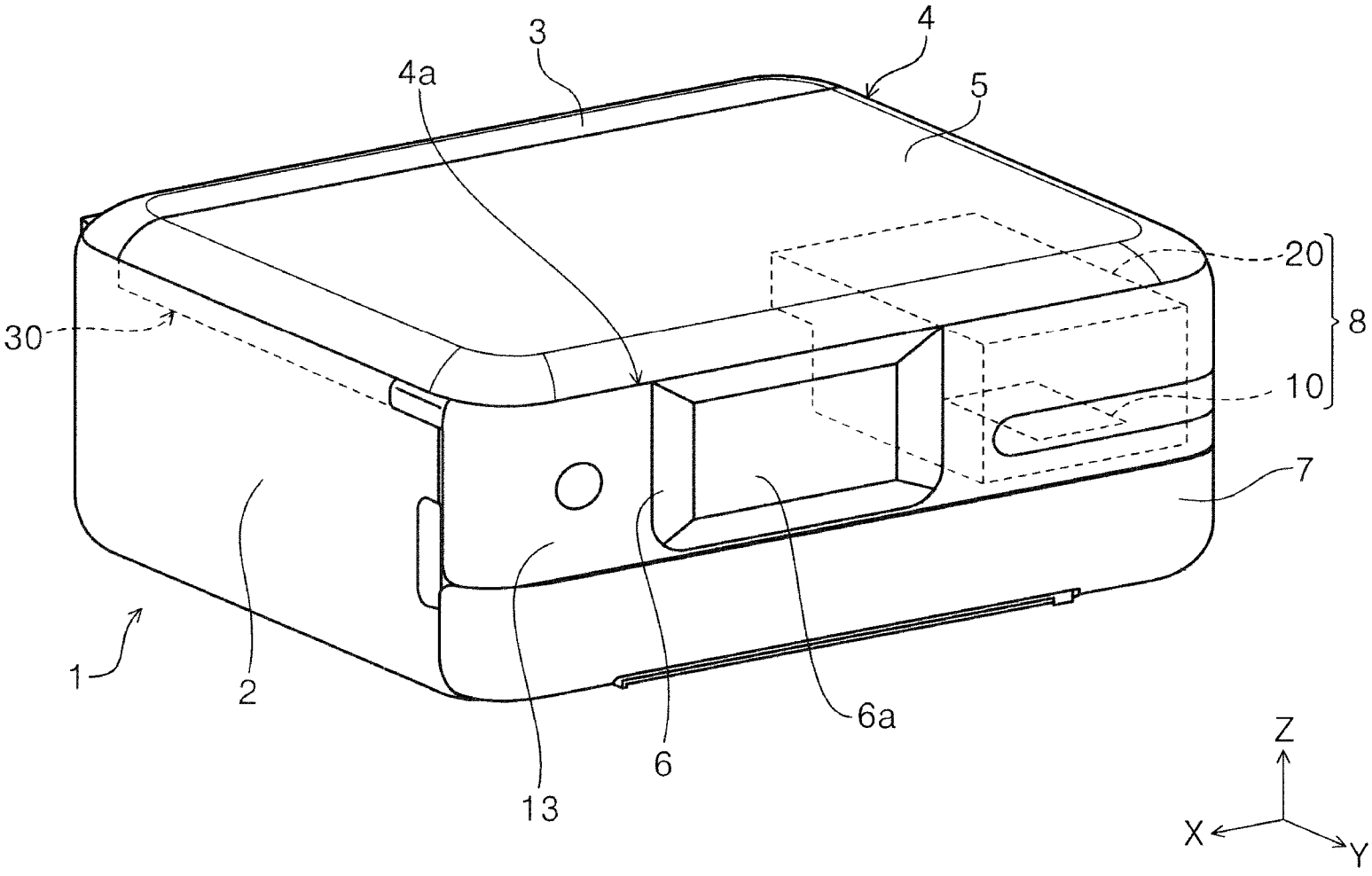
FIG. 1 is an external perspective view of a printer according to Embodiment 1.

Hereinafter, the present disclosure will be schematically described.

According to an aspect of the present disclosure, there is provided a recording apparatus including a recording head that performs recording on a medium that is transported, a carriage that has the recording head mounted thereon and is movable in a width direction intersecting a transport direction of the medium, a guide member that extends in the width direction and guides the carriage, and a gap adjustment unit that displaces the carriage in a first axis direction to change a gap between the recording head and a support surface. The gap adjustment unit has a sliding member that moves in the width direction integrally with the carriage while the sliding member slides with respect to the guide member, and a cam member that is interposed between the carriage and the sliding member and has a stepped portion in which a maintenance surface that maintains a position of the carriage in the first axis direction and an adjustment surface that changes the position of the carriage in the first axis direction are alternately arranged in the width direction. The gap adjustment unit is configured such that the cam member slides in the width direction with respect to the carriage and the sliding member to change the gap. The gap adjustment unit includes a buffer unit that decreases a displacement speed of the carriage in the first axis direction when the gap is reduced.

According to this aspect, the gap adjustment unit includes a sliding member that moves in the width direction integrally with the carriage while the sliding member slides with respect to the guide member, a cam member that is interposed between the carriage and the sliding member, includes the stepped portion, and slides in the width direction to displace the carriage in the first axis direction with respect to the sliding member, and a buffer unit that decreases a displacement speed of the carriage in the first axis direction. Thus, the carriage can be displaced slowly, and sound generated when the carriage is displaced can be suppressed.

A second aspect of the present disclosure provides the recording apparatus according to the first aspect, in which the buffer unit acts on the carriage that displaces in a direction including a vertical downward component in the first axis direction, and does not act on the carriage that displaces in a direction including a vertical upward component in the first axis direction.

According to this aspect, the buffer unit acts on the carriage displaced in a direction including a vertical downward component in the first axis direction and does not act on the carriage displaced in a direction including a vertical upward component. Therefore, when the carriage is displaced in the direction including the vertical downward component, the carriage is decelerated by the buffer unit, the carriage is vigorously displaced due to a self-weight thereof, and thus, a possibility that a loud sound occurs can be reduced. On the other hand, since the buffer unit does not act when the carriage is displaced upward, an increase in a load when the carriage is displaced upward can be suppressed.

A third aspect of the present disclosure provides the recording apparatus according to the second aspect, in which the stepped portion includes, as the maintenance surface, a first maintenance surface that maintains the position of the carriage with respect to the sliding member at a first position, a second maintenance surface that maintains the position of the carriage with respect to the sliding member at a second position at which the gap is smaller than the gap at the first position, and a third maintenance surface that maintains the position of the carriage with respect to the sliding member at a third position at which the gap is smaller than the gap at the second position, a height difference between the first position and the second position in the first axis direction is larger than a height difference between the second position and the third position in the first axis direction, and the buffer unit acts when the gap is changed from a size defined at the first position to a size defined at the second position, and does not act when the gap is changed from the size defined at the second position to a size defined at the third position.

According to this aspect, only when a loud sound is likely to be generated since the carriage is greatly displaced downward, the buffer unit acts on the carriage, so that generation of the sound due to the displacement of the carriage can be effectively suppressed.

A fourth aspect of the present disclosure provides the recording apparatus according to any of the first aspect to the third aspect, in which the buffer unit includes a rack and pinion mechanism, a rack constituting the rack and pinion mechanism is provided on the sliding member along the first axis direction, a pinion gear constituting the rack and pinion mechanism is provided on the carriage, and resistance is applied to the pinion gear upon rotation, and the displacement speed of the carriage is reduced.

According to this aspect, since the buffer unit includes the rack and pinion mechanism, and rotational resistance is applied to the pinion gear constituting the rack and pinion mechanism, the buffer unit can be configured with a simple structure at low costs.

A fifth aspect of the present disclosure provides the recording apparatus according to the fourth aspect, in which the buffer unit is configured to apply the resistance to the pinion gear by a damper.

According to this aspect, a simple configuration can be achieved in which the rotational resistance is applied to the pinion gear.

A sixth aspect of the present disclosure provides the recording apparatus according to the fourth aspect, in which the buffer unit includes a driven gear that engages with the pinion gear and is driven to rotate, and a reduction gear ratio when power is transmitted from the pinion gear to the driven gear is larger than 1, and the driven gear applies the resistance to the pinion gear.

According to this aspect, a simple configuration can be achieved in which the rotational resistance is applied to the pinion gear.

A seventh aspect of the present disclosure provides the recording apparatus according to any of the first aspect to the third aspect, in which the buffer unit includes an elastic member provided between the sliding member and the carriage, and the displacement speed of the carriage is reduced by elasticity of the elastic member.

According to this aspect, an elastic member provided between the sliding member and the carriage is used as the buffer unit, so that the same effect as any of the first to third aspects can be achieved with a simple configuration.

An eighth aspect of the present disclosure provides the recording apparatus according to any of the first aspect to the third aspect, in which the buffer unit includes a rack and pinion mechanism, a rack constituting the rack and pinion mechanism is provided on the cam member along the width direction, a pinion gear constituting the rack and pinion mechanism is provided on the carriage, and resistance is applied to the pinion gear upon rotation, and the displacement speed of the carriage is reduced.

According to this aspect, since the rack constituting the rack and pinion mechanism is provided on the cam member along the width direction, the length of the rack can be increased, and the rotation amount of the pinion gear can be further secured. Therefore, influence of a backlash in meshing of gears can be reduced, and the sound generated when the carriage is displaced can be suppressed more reliably.

A ninth aspect of the present disclosure provides the recording apparatus according to the eighth aspect, in which the cam member displaces in an area in a direction opposite to a direction of a home position of the carriage with respect to a central position of the carriage in the width direction, and the buffer unit is provided in the direction opposite to the direction of the home position of the carriage with respect to the central position of the carriage in the width direction. Accordingly, an increase in the size of the apparatus can be suppressed. Details thereof will be described later.

A tenth aspect of the present disclosure provides a recording apparatus including a recording head that performs recording on a medium that is transported, a carriage that has the recording head mounted thereon and is movable in a width direction intersecting a transport direction of the medium, a guide member that extends in the width direction and guides the carriage, and a gap adjustment unit that displaces the carriage in a first axis direction to change a gap between the recording head and a support surface. The gap adjustment unit has a sliding member that moves in the width direction integrally with the carriage while the sliding member slides with respect to the guide member, and a cam member that is interposed between the carriage and the sliding member and has a stepped portion in which a maintenance surface that maintains a position of the carriage in the first axis direction and an adjustment surface that changes the position of the carriage in the first axis direction are alternately arranged in the width direction. The gap adjustment unit is configured such that the cam member slides in the width direction with respect to the carriage and the sliding member to change the gap. The stepped portion includes, as the maintenance surface, a first maintenance surface that maintains a position of the carriage with respect to the sliding member at a first position, a second maintenance surface that maintains the position of the carriage with respect to the sliding member at a second position at which the gap is smaller than the gap at the first position, and a third maintenance surface that maintains the position of the carriage with respect to the sliding member at a third position at which the gap is smaller than the gap at the second position. A height difference between the first position and the second position in the first axis direction is larger than a height difference between the second position and the third position in the first axis direction. The stepped portion includes, as the adjustment surface, a first adjustment surface that couples the first maintenance surface and the second maintenance surface and a second adjustment surface that couples the second maintenance surface and the third maintenance surface. An inclination angle of the first adjustment surface with respect to a horizontal plane is smaller than an inclination angle of the second adjustment surface with respect to the horizontal plane.

According to this aspect, in the stepped portion, an inclination angle of the first adjustment surface that is an adjustment surface for changing the position of the carriage from the first position to the second position is smaller than an inclination angle of the second adjustment surface that is an adjustment surface for changing the position of the carriage from the second position to the third position. Thus, when the carriage is displaced more greatly, the first adjustment surface is used, and a sound generated with the displacement of the carriage can be reduced.

Embodiment 1

Hereinafter, an outline of a recording apparatus according to an embodiment of the present disclosure will be described. In the present embodiment, an ink jet printer 1 is described as an example of the recording apparatus. Hereinafter, the ink jet printer 1 is simply referred to as a printer 1.

In an XYZ coordinate system illustrated in each drawing, an X-axis direction indicates an apparatus width direction, a Y-axis direction indicates an apparatus depth direction, and a Z-axis direction indicates an apparatus height direction. Further, the +Y direction indicates a forward direction of the apparatus, and the −Y direction indicates a rearward direction of the apparatus. Further, when viewed from the forward direction of the apparatus, a leftward direction indicates the +X direction, and a rightward direction indicates the −X direction. Further, the +Z direction indicates an upward direction, and the −Z direction indicates a downward direction.

Further, in the printer 1, a transport direction in which a medium is transported is referred to as a "downstream direction", and a direction that is opposite thereto is referred to as an "upstream direction".

Outline of Printer

The printer 1 illustrated in FIG. 1 includes a housing 2 that includes a recording unit 8 that performs recording on a medium, and a scanner unit 4 that is provided on the housing 2 and reads an image of a document. That is, the printer 1 is configured as a multi-function machine having an image reading function in addition to a recording function.

In the printer 1, examples of the medium on which the recording is performed include, in addition to plain paper, thick paper that is thicker than the plain paper, such as a postcard and a business card, thin paper that is thinner than the plain paper, glossy paper for photography, and the like. Further, the printer 1 is configured to also perform recording on a label surface of a disc-type memory such as a CD and a DVD.

In the printer 1, the recording unit 8 includes a recording head 10 that performs recording on the medium by ejecting an ink as a liquid, and a carriage 20 that supports the recording head 10, and is configured to perform the recording by ejecting the ink from the recording head 10 toward the medium P.

The carriage 20 is configured to reciprocate in the X-axis direction that is a width direction intersecting the transport direction of the medium P.

Figure 2:
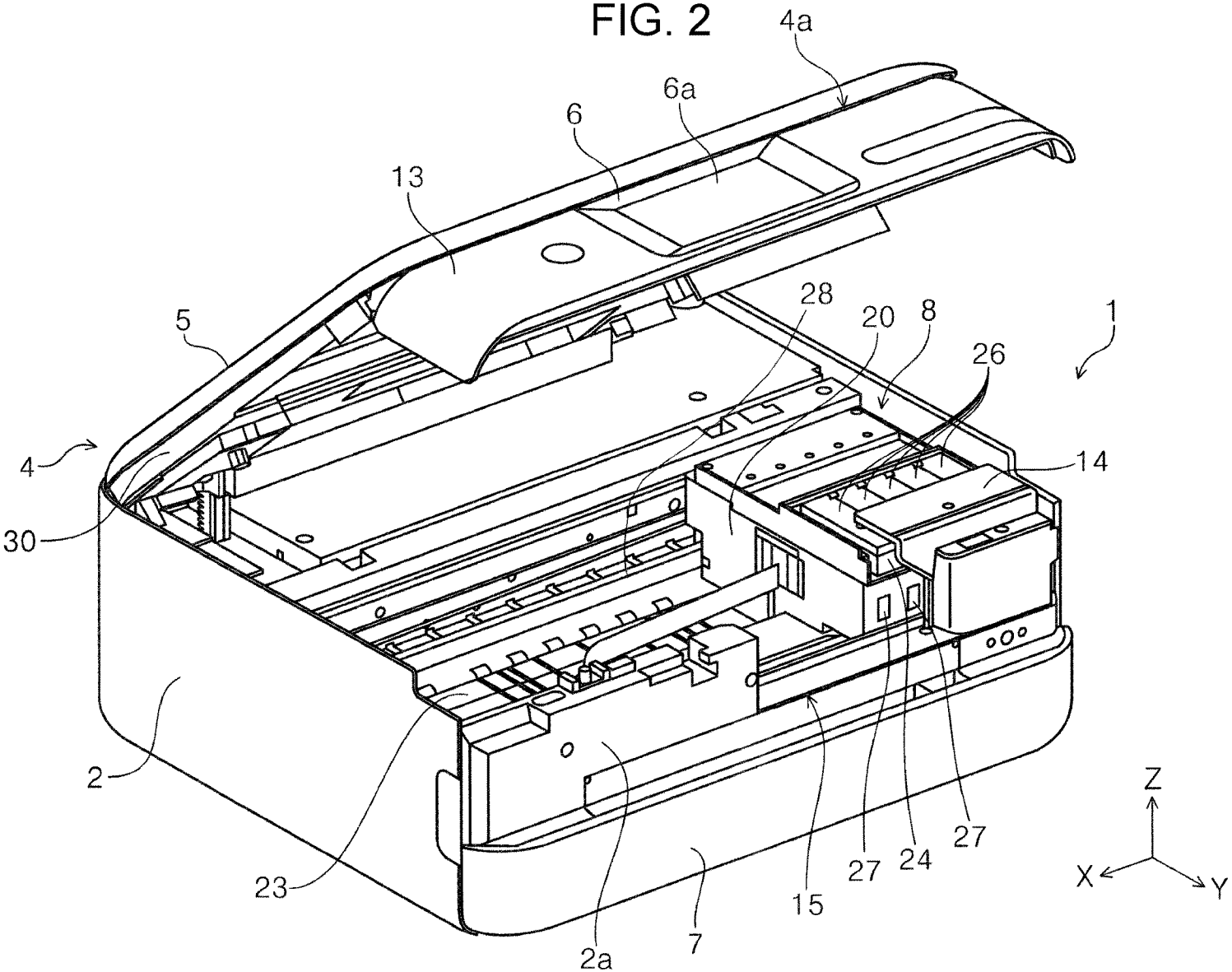
FIG. 2 is a perspective view illustrating a state in which a scanner unit is completely opened in the printer according to Embodiment 1.

The scanner unit 4 is provided to be pivotable with respect to the housing 2 and is configured to be able to open and close an upper portion of the housing 2 through pivot. FIG. 1 illustrates a closed state in which the scanner unit 4 is closed with respect to the housing 2, and FIG. 2 illustrates an opened state in which the scanner unit 4 is completely opened with respect to the housing 2.

A panel unit 13 including an operation unit 6 is provided in the +Y direction that is the forward direction of the printer 1. The operation unit 6 can perform preview display of setting contents or an image in addition to various setting operations and execution operations for recording and image reading.

The panel unit 13 is provided in the scanner unit 4, and is configured to be pivotable from a state in which an operation surface 6*a* illustrated in FIG. 1 faces the front side in a direction in which the operation surface 6*a* faces the upper side.

A lower cover 7 is provided at a lower portion of a front surface 2*a* of the housing 2. The front surface 2*a* of the housing 2 is not visible in FIG. 1 but is illustrated in FIG. 2.

Figure 3:
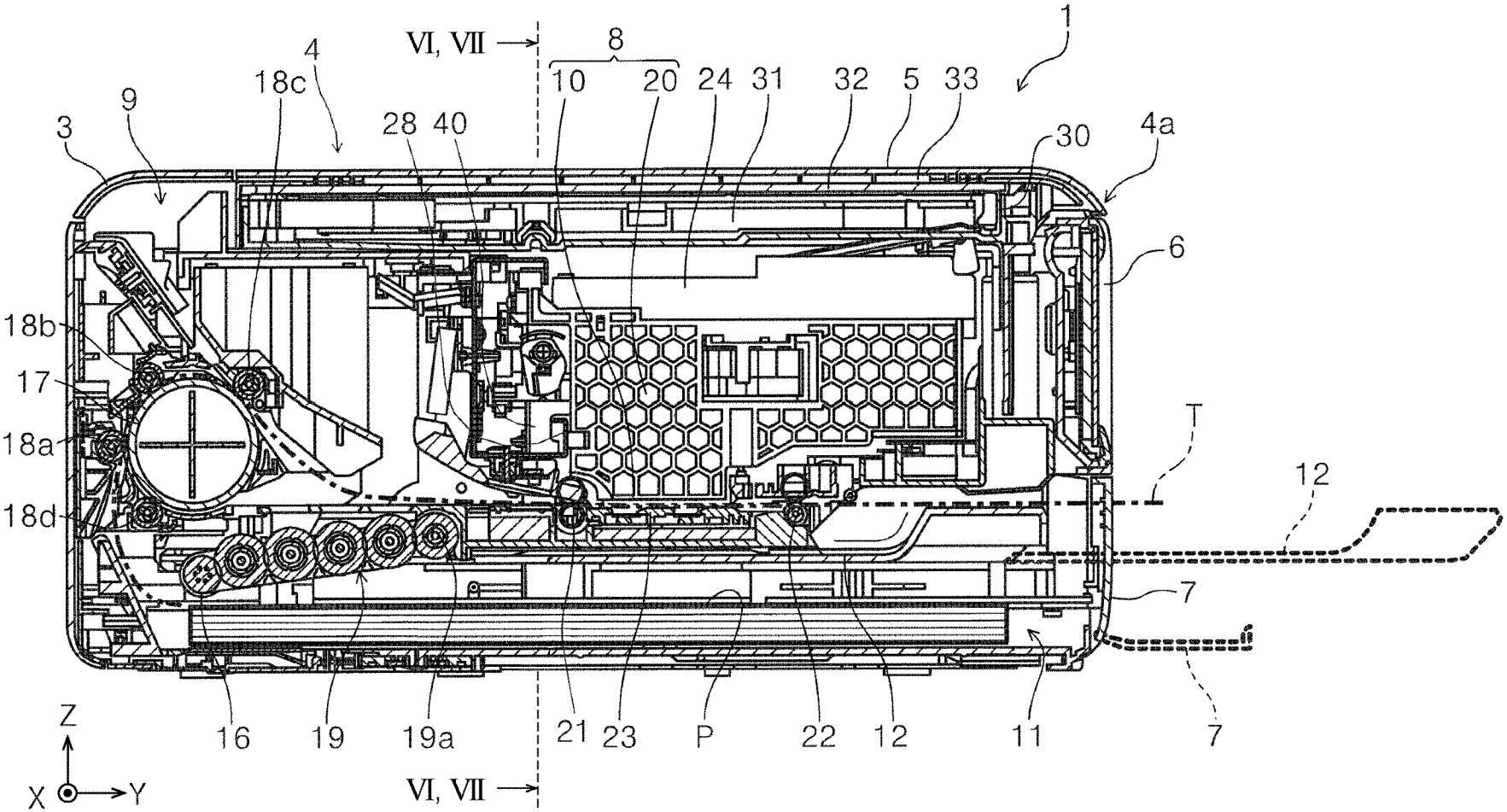
FIG. 3 is a side sectional view of the printer according to Embodiment 1.

By opening the lower cover 7 as indicated by a dotted line in FIG. 3, a medium tray 11 for accommodating the medium P before recording and a discharge tray 12 for receiving the medium P discharged after the recording are exposed.

The discharge tray 12 can be switched between a storage state in which the discharge tray 12 is stored in the housing 2 as indicated by a solid line in FIG. 3 and a protrusion state in which the discharge tray 12 protrudes toward the front side of the housing 2 as indicated by a dotted line in FIG. 3, and can receive the medium P after recording in the protrusion state. The discharge tray 12 is configured to be switchable between the storage state and the protrusion state by a drive source that is not illustrated.

The medium tray 11 can accommodate a plurality of media P, and is detachable from the housing 2. As illustrated in FIG. 3, the medium tray 11 can send the medium P to a medium transport path T, which will be described below, while being mounted on the housing 2. Further, the medium tray 11 can be replenished with the medium P while being pulled out forward (in the +Y direction).

In Medium Transport Path in Printer

Next, the medium transport path T of the printer 1 will be described with reference to FIG. 3. The medium transport path T is a transport path for the medium P transported from the medium tray 11 provided at a lower portion of the printer 1 toward an area in which recording is performed by the recording unit 8.

The medium P set on the medium tray 11 is picked up by the feeding roller 16 and is sent out to the medium transport path T. In more detail, the feeding roller 16 that is rotationally driven by the drive source that is not illustrated is provided in a roller support member 19 that swings about a swing shaft 19*a*, rotates while being in contact with the uppermost medium P of the plurality of media P accommodated in the medium tray 11, and sends out the uppermost medium P from the medium tray 11 in the rearward direction of the apparatus (in the −Y direction).

An intermediate roller 17 that is rotationally driven by the drive source that is not illustrated is provided downstream of the feeding roller 16, and the medium P is curved and reversed by the intermediate roller 17, and is sent in the forward direction of the apparatus (in the +Y direction). Reference numerals 18*a*, 18*b*, 18*c*, and 18*d* are driven rollers that can be driven and rotated by the intermediate roller 17, and the medium P is nipped by the driven roller 18*a* and the intermediate roller 17, is nipped by the driven roller 18*b* and the intermediate roller 17, is then nipped by the driven roller 18*c* and the intermediate roller 17, and is sent downstream. The driven roller 18*d* will be described later.

A transport roller pair 21 is provided downstream of the intermediate roller 17, and the medium P is sent to a lower side of the recording head 10 by the transport roller pair 21. In FIG. 3, the transport roller pair 21 has a lower roller rotationally driven by the drive source that is not illustrated, and an upper roller driven and rotated by the lower roller.

The recording unit 8 including the recording head 10 and the carriage 20 is provided downstream of the transport roller pair 21. The recording head 10 that ejects the ink is provided at the bottom of the carriage 20. A liquid accommodation portion 24 for accommodating the ink supplied to the recording head 10 is mounted on the carriage 20. In other words, the housing 2 includes the liquid accommodation portion 24 therein.

Figure 5:
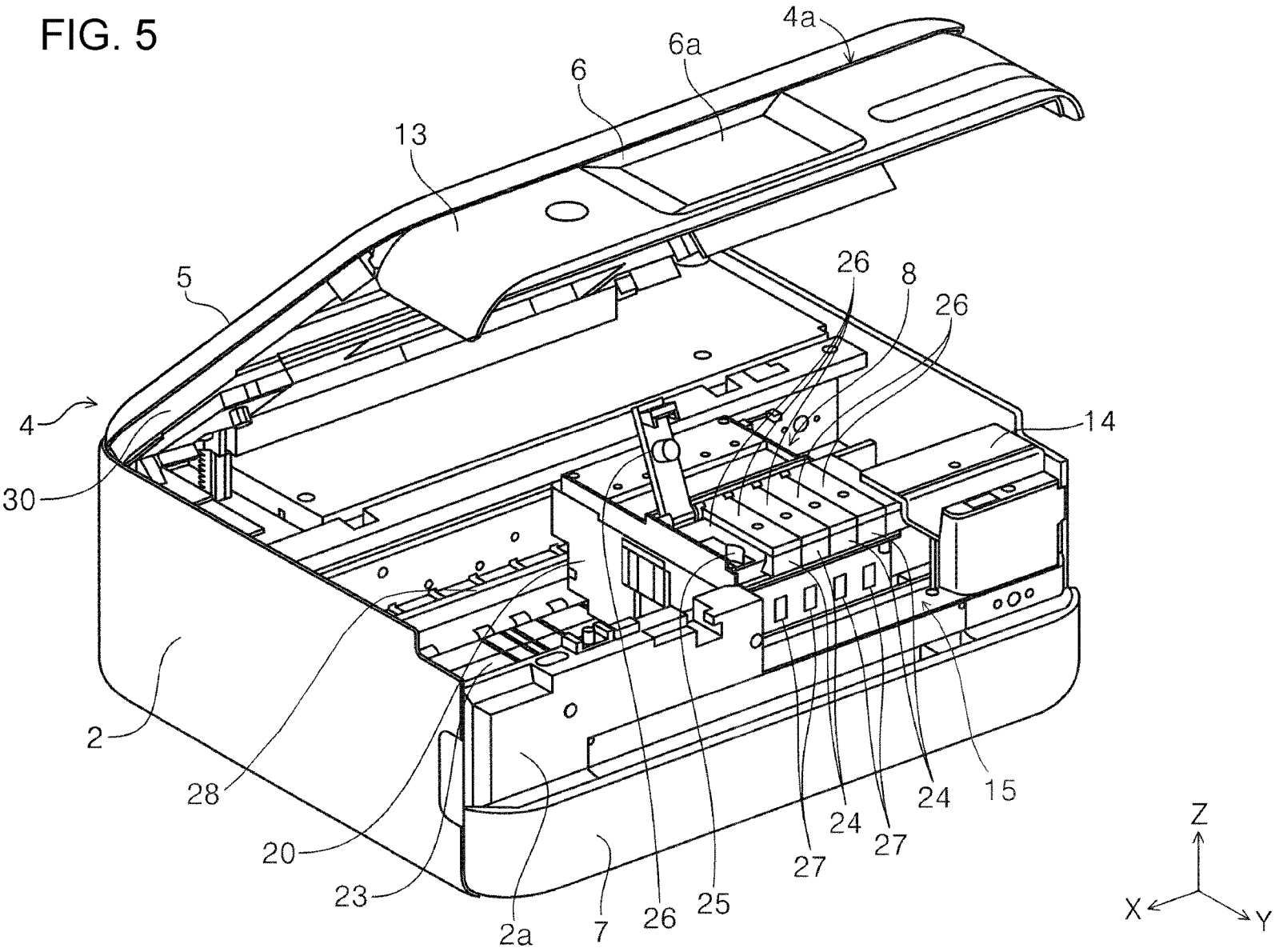
FIG. 5 is a perspective view illustrating a state in which a carriage is moved to a position when the ink is replenished in a liquid accommodating unit, in the printer according to Embodiment 1.

The liquid accommodation portion 24 can be replenished with the ink, the amount of which is reduced by recording. As in FIG. 3, in a state in which the scanner unit 4 is opened, the liquid accommodation portion 24 is replenished with the ink. A plurality of the liquid accommodation portions 24 corresponding to a plurality of colors are mounted on the carriage 20. A cap 26 for closing an ink supply port 25 illustrated in FIG. 5 is provided on each liquid accommodation portion 24. FIG. 5 illustrates a state in which the cap 26 of the leftmost liquid accommodation portion 24 is opened when the drawing is viewed from the front side. The cap 26 opens and closes the ink supply port 25 by pivoting about the rearward direction of the apparatus (the −Y direction). The ink can be poured into the liquid accommodation portion 24 from the ink supply port 25.

Further, the liquid accommodation portion 24 can be disposed inside or outside the housing 2 without being mounted on the carriage 20 and can be configured to supply the ink to the recording head 10 via a tube.

In FIG. 2, the carriage 20 is located at a home position. The home position is provided at one end of a moving area of the carriage 20, and is set at an end in the −X direction in the present embodiment. An eaves member 14 is provided in front of the housing 2 in the −X direction, and when the carriage 20 is located at the home position, the liquid accommodation portion 24 with the cap 26 closed is located below the eaves member 14. The carriage 20 can be located at the home position by the eaves member 14 with the cap 26 securely closed.

Since the eaves member 14 exists, the cap 26 of the liquid accommodation portion 24 cannot be opened when the carriage 20 is located at the hoe position. When the liquid accommodation portion 24 is replenished with the ink, for example, an ink replenishment mode is selected in the operation unit 6, so that the carriage 20 can be moved to a position where the cap 26 is not covered by the eaves member 14, as illustrated in FIG. 5.

As illustrated in FIG. 2, a notch 15 is provided in the front surface 2*a* of the housing 2. A window portion 27 that allows the user to visually recognize the amount of the ink therein is provided on a side surface of the liquid accommodation portion 24 in the +Y direction. In the ink replenishment mode, the carriage 20 is moved to a position where the carriage 20 overlaps the notch 15 in the X-axis direction as illustrated in FIG. 5. Accordingly, the ink can be replenished while the user checks the amount of the ink in the liquid accommodation portion 24.

When the replenishment of the ink is completed, for example, the ink replenishment mode is terminated in the operation unit 6, so that the carriage 20 can return to the home position. Further, it is detected that the scanner unit 4 is closed with respect to the housing 2, and the carriage 20 returns to the home position using the detection result as a trigger.

The carriage 20 reciprocates in the width direction (the X-axis direction) by the drive source that is not illustrated. The printer 1 includes a guide member 28 extending in the width direction as illustrated in FIG. 2, and the carriage 20 moves in the width direction along the guide member 28. The guide member 28 guides the carriage 20 in the width direction.

In FIG. 3, a medium support member 23 that forms a support surface that supports the medium P transported through the medium transport path T is provided in a position facing the recording head 10. The upper surface of the medium support member 23 serves as the support surface of the medium P. The medium P is supported on the medium support member 23, and an interval between the medium P and the recording head 10 is defined.

The interval between the medium P and the recording head 10, which is suitable for the recording, varies depending on the type of the medium P. Therefore, the printer 1 includes a gap adjustment unit 40 that displaces the carriage 20 in a first axis direction in which a gap between the recording head 10 and the medium support member 23 (the support surface) that supports the medium P at a position where the medium support member 23 faces the recording head 10 changes. In the present embodiment, the first axis direction is the Z-axis direction. The gap adjustment unit 40 will be described below.

A discharge roller pair 22 is provided downstream of the medium support member 23. Similar to the transport roller pair 21, the discharge roller pair 22 is also configured such that a lower roller is rotationally driven by a drive source that is not illustrated, and an upper roller is driven and rotated by the lower roller. The medium P after recording by the recording unit 8 is discharged by the discharge roller pair 22 toward the discharge tray 12 in the protrusion state as indicated by a dotted line in FIG. 3.

The printer 1 is configured to be able to perform double-sided recording in which recording is performed on a first surface of the medium P and a second surface opposite to the first surface. When performing the double-sided recording, after the recording on the first surface, the medium P is switched back and is sent in the −Y direction. The switched-back medium P can be nipped by the driven roller 18*d* and the intermediate roller 17 and can be joined to the medium transport path T. The medium P is reversed by the intermediate roller 17 and is transported to the lower side of the recording head 10 in a state in which the second surface faces the recording head 10, and the recording is performed on the second surface.

Further, the printer 1 is configured to be able to supply the medium P, on which the recording is performed, also from an upper supply port 9 provided at an upper portion in the rearward direction of the apparatus. The upper supply port 9 is opened by opening a feeding port cover 3. The medium P supplied from the upper supply port 9 enters the medium transport path T from upstream of the transport roller pair 21, and the recording on the medium P is performed by the recording head 10.

In Scanner Unit

In the printer 1, as illustrated in FIG. 2, the scanner unit 4 is provided to be pivotable with respect to the upper portion of the housing 2. The scanner unit 4 has a pivot shaft in the rearward direction of the apparatus, that is, the −Y direction, and pivots with an end in the forward direction of the apparatus, that is, the +Y direction, as a free end 4*a*. The scanner unit 4 is configured to be able to open and close the upper portion of the housing 2 through pivot.

Figure 4:
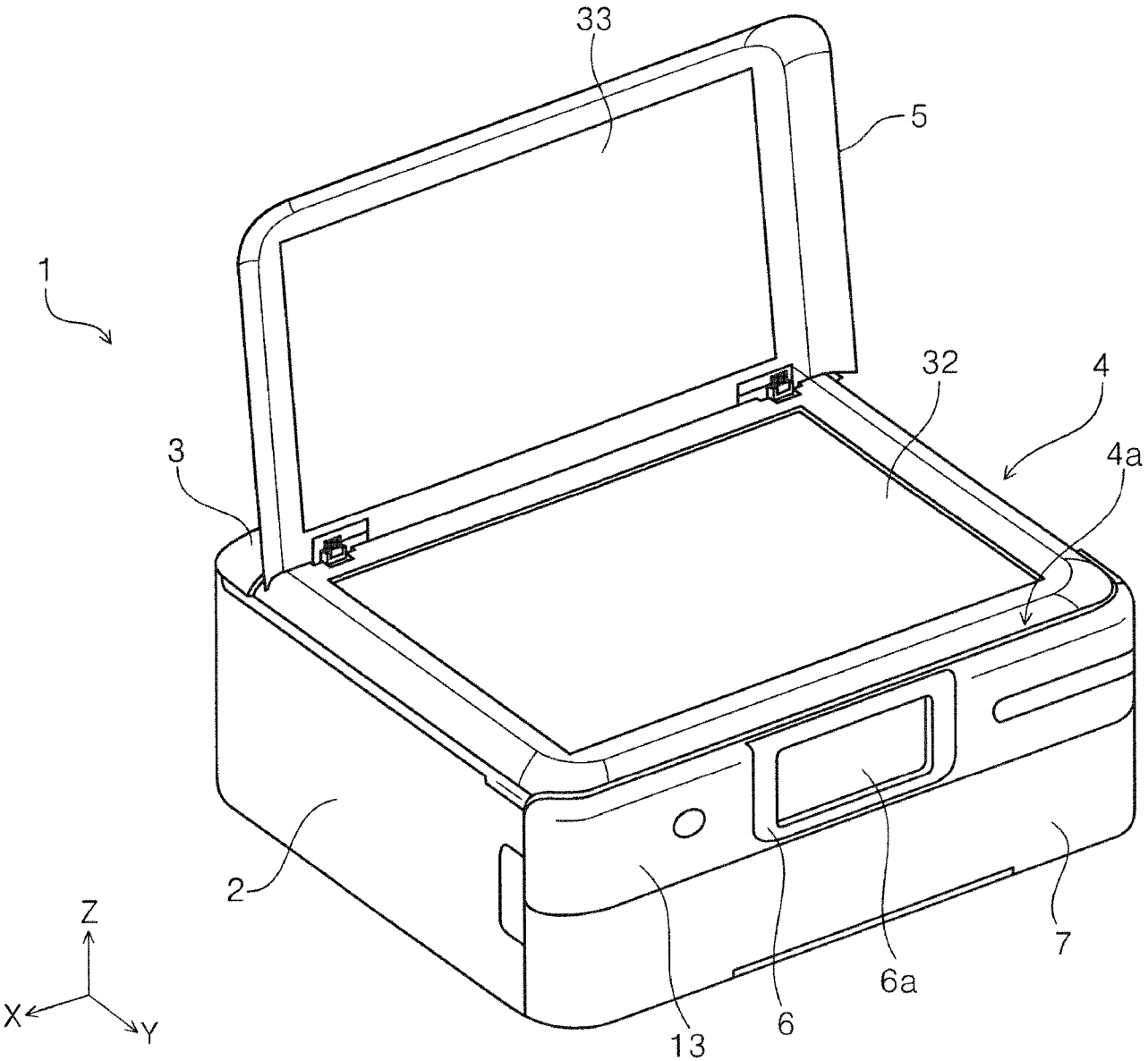
FIG. 4 is a perspective view illustrating a state in which a document table cover of the scanner unit is opened in the printer according to Embodiment 1.

As illustrated in FIG. 3, the scanner unit 4 includes a scanner body 30 that includes a reading unit 31 therein, and a document table cover 5 that can open and close a document table 32 provided at an upper portion of the scanner body 30. When the document table cover 5 is opened as illustrated in FIG. 4, the document table 32 is exposed. The reading unit 31 illustrated in FIG. 3 reads a document placed on the document table 32. The document is placed on the document table 32 in a state in which a reading surface faces the document table 32.

When the document table cover 5 is closed, as illustrated in FIG. 4, a presser plate 33 that presses the document is provided on a surface facing the document table 32.

The panel unit 13 is provided in the scanner body 30, and the document table cover 5 can be opened and closed alone.

In Gap Adjustment Unit

Hereinafter, the gap adjustment unit 40 will be described in detail.

Figure 6:
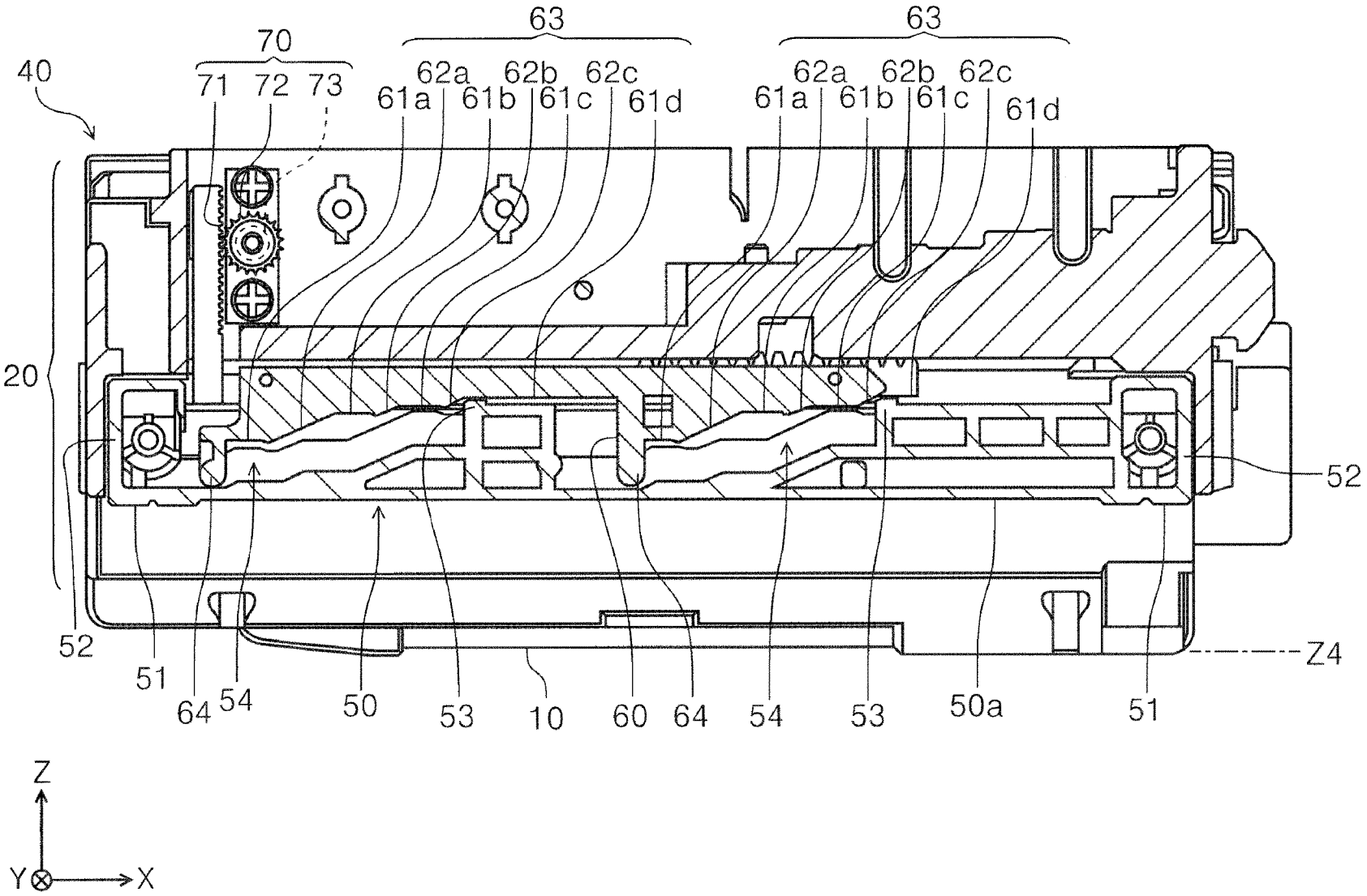
FIG. 6 is a cross-sectional view taken along line VI-VI in FIG. 3 of the carriage, and is a view illustrating a state in which a contact portion of a sliding member is in contact with a fourth maintenance surface of a stepped portion of a cam member.

The gap adjustment unit 40 includes a sliding member 50 and a cam member 60, illustrated in FIG. 6. Then, the gap adjustment unit 40 is configured to change a gap when the cam member 60 slides in the width direction with respect to the carriage 20 and the sliding member 50.

Hereinafter, a configuration in which the gap adjustment unit 40 changes the gap will be described in detail.

The sliding member 50 can move in the width direction (the X-axis direction) integrally with the carriage 20 while sliding with respect to the guide member 28 illustrated in FIGS. 2 and 3.

In more detail, in FIG. 6, sliding portions 51 that are in contact with the guide member 28 are provided at both ends of a lower surface 50*a* of the sliding member 50 in the width direction. Further, regulation portions 52 that abut on the carriage 20 and regulate movement of the sliding member 50 in the width direction with respect to the carriage 20 are provided at both ends of the sliding member 50 in the width direction. The carriage 20 is provided to be displaceable in the Z-axis direction, which is the first axis direction, without changing the position thereof in the width direction with respect to the sliding member 50.

Further, a contact portion 53 that is in contact with a stepped portion 63 of the cam member 60, which will be described below, is provided at an upper portion of the sliding member 50.

As illustrated in FIG. 6, the cam member 60 is interposed between the carriage 20 and the sliding member 50 and has the stepped portion 63 in which a maintenance surface 61 that maintains the position of the carriage 20 in the first axis direction (the Z-axis direction), and an adjustment surface 62 that changes the position of the carriage 20 in the first axis direction are alternately arranged in the width direction. The maintenance surface 61 is formed on a horizontal plane that intersects the Z-axis direction that is the first axis direction, and the adjustment surface 62 is formed on an inclined surface that couples the two maintenance surfaces 61 having different heights.

Figure 7:
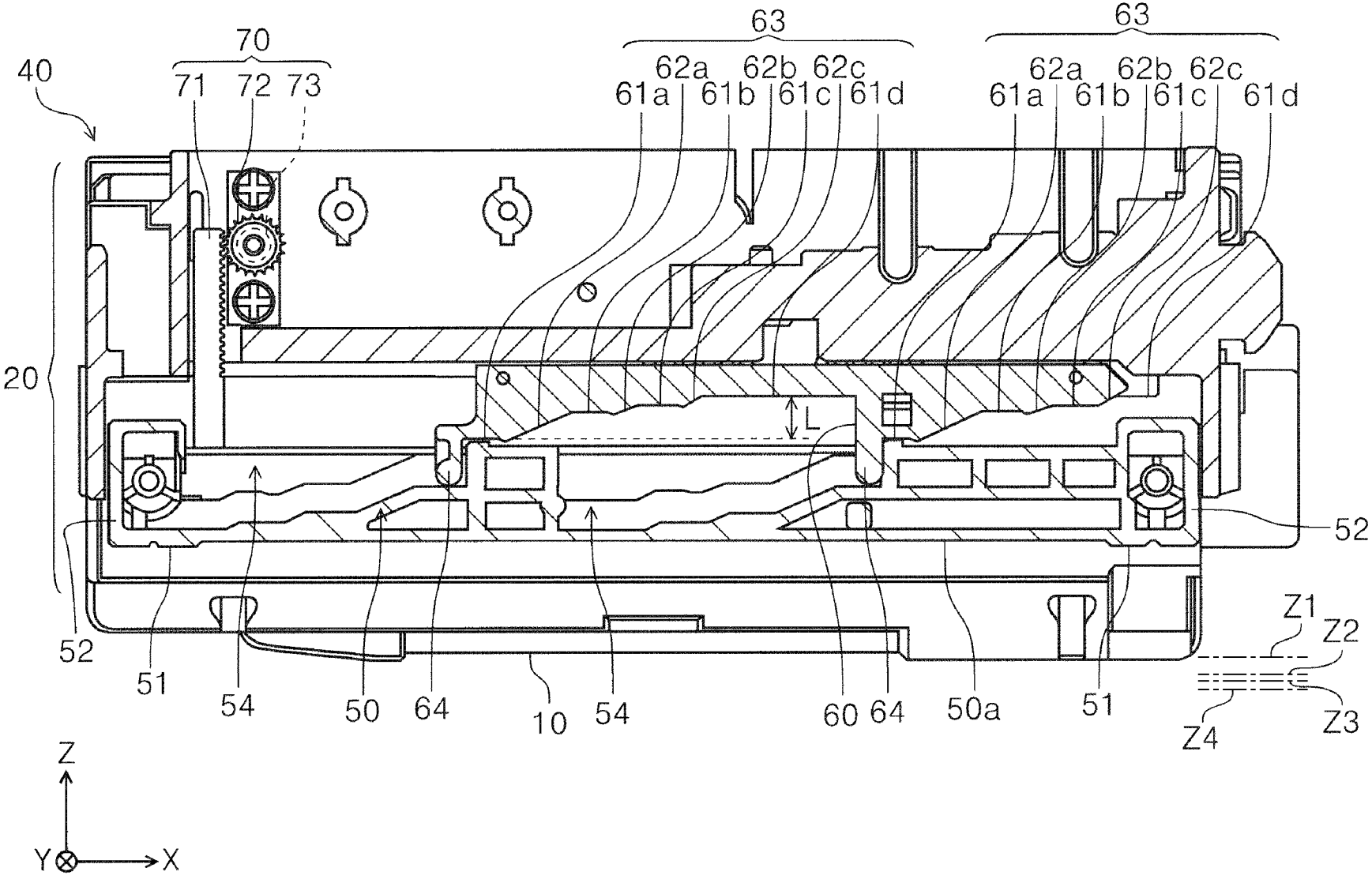
FIG. 7 is a cross-sectional view taken along line VII-VII in FIG. 3 of the carriage, and is a view illustrating a state in which the contact portion of the sliding member is in contact with a first maintenance surface of the stepped portion of the cam member.
Figure 8:
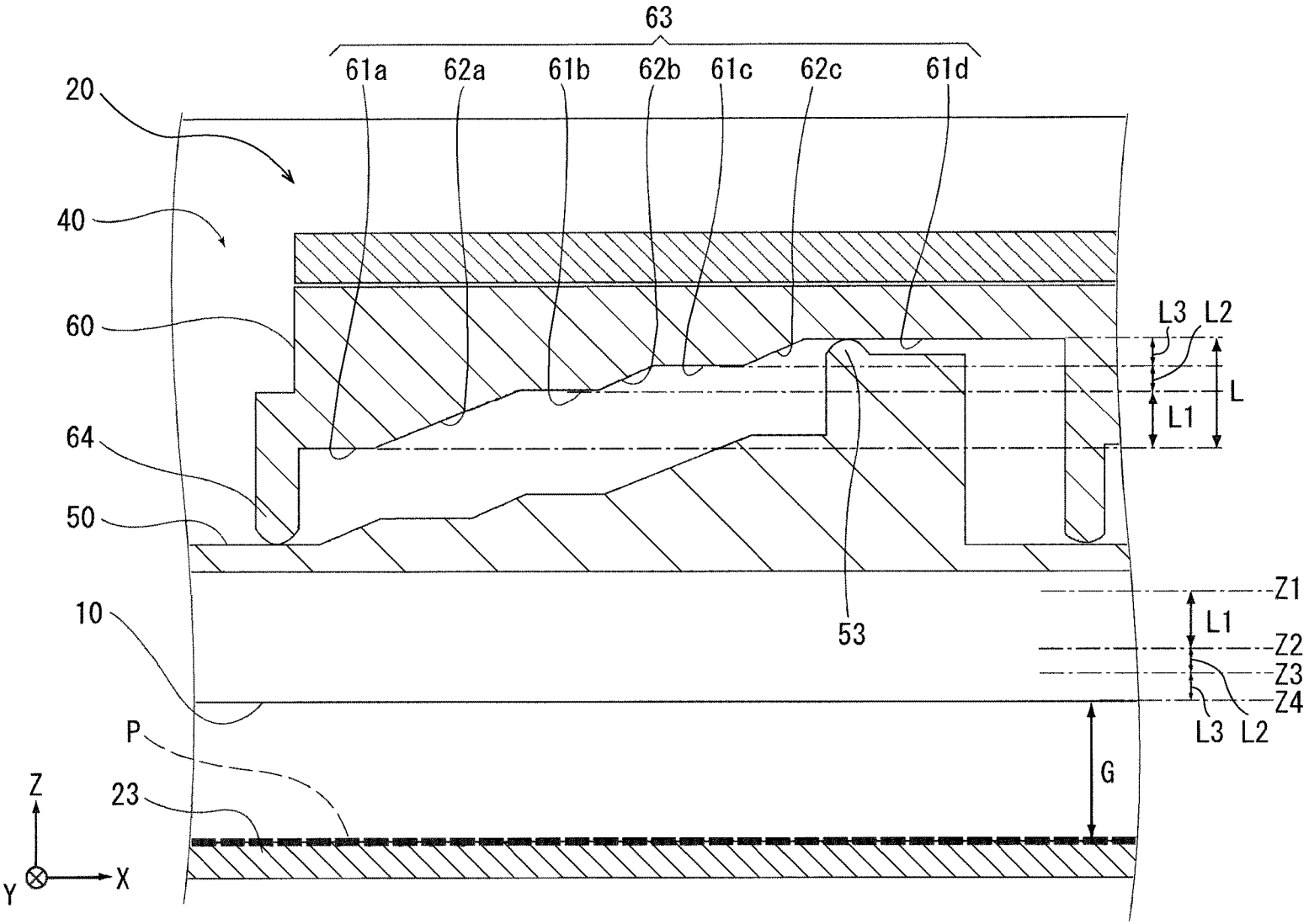
FIG. 8 is a schematic view illustrating a main portion of FIG. 6.

In the present embodiment, the stepped portion 63 includes, as the maintenance surface 61, a first maintenance surface 61*a* which maintains the position of the carriage 20 with respect to the sliding member 50 at a first position Z1 illustrated in FIGS. 7 and 8, a second maintenance surface 61*b* which maintains the position at a second position Z2 having a gap G (see FIG. 8) that is smaller than that of the first position Z1, a third maintenance surface 61*c* which maintains the position at a third position Z3 having the gap G that is smaller than that of the second position Z2, and a fourth maintenance surface 61*d* which maintains the position at a fourth position Z4 having the gap G that is smaller than that of the third position Z3. A height difference L3 between the first position Z1 and the second position Z2 in the first axis direction (the Z-axis direction) is larger than a height difference L2 between the second position Z2 and the third position Z3 in the first axis direction.

In the stepped portion 63 illustrated in FIGS. 6 to 8, the first maintenance surface 61*a*, a first adjustment surface 62*a*, the second maintenance surface 61*b*, a second adjustment surface 62*b*, the third maintenance surface 61*c*, a third adjustment surface 62*c*, and the fourth maintenance surface 61*d* are arranged in this order from the left side when the drawings are viewed from the front side.

The cam member 60 is attached to the carriage 20 by an attachment portion that is provided on the upper side and is not illustrated, and regulates displacement in the Z-axis direction such that the cam member 60 is not separated from the carriage 20. The cam member 60 is configured to be slidable in the X-axis direction that is the width direction without changing the position thereof in the Z-axis direction that is the first axis direction with respect to the carriage 20.

The cam member 60 includes a guide pin 64 at the bottom thereof. The sliding member 50 includes a guide groove 54 formed in a shape corresponding to the stepped portion 63. When the cam member 60 slides in the width direction, the guide pin 64 is guided to the guide groove 54 of the sliding member 50.

FIG. 6 illustrates a state in which the contact portion 53 of the sliding member 50 is in contact with the fourth maintenance surface 61*d* of the stepped portion 63 of the cam member 60, and a lower portion of the carriage 20 is located in the fourth position Z4 in the Z-axis direction.

From the state of FIG. 6, as illustrated in FIG. 7, when the cam member 60 is slid in the +X direction so that the contact portion 53 of the sliding member 50 comes into contact with the first maintenance surface 61*a* of the stepped portion 63, the carriage 20 is displaced in the Z-axis direction with respect to the sliding member 50 by a height difference L between the fourth maintenance surface 61*d* and the first maintenance surface 61*a*, and the carriage 20 is located at the first position Z1.

As illustrated in FIG. 8, in the stepped portion 63, L1 denotes an interval between the first maintenance surface 61*a* and the second maintenance surface 61*b* as adjacent maintenance surfaces 61, L2 denotes an interval between the second maintenance surface 61*b* and the third maintenance surface 61*c* as adjacent maintenance surfaces 61, and L3 denotes an interval between the third maintenance surface 61*c* and the fourth maintenance surface 61*d* as adjacent maintenance surfaces 61.

From the state illustrated in FIG. 7, that is, a state in which the contact portion 53 comes into contact with the first maintenance surface 61*a* so that the recording head 10 is located at the first position Z1 in the Z-axis direction, when the cam member 60 is slid in the −X direction, the contact portion 53 can be guided by the first adjustment surface 62*a* and brought into contact with the second maintenance surface 61*b*. At this time, the carriage 20 is displaced in the −Z direction, and the carriage 20 is located at the second position Z2.

Further, when the cam member 60 is slid in the −X direction, the contact portion 53 can be guided by the second adjustment surface 62*b* and can be brought into contact with the third maintenance surface 61*c*. At this time, the carriage 20 is displaced in the −Z direction, and the carriage 20 is located at the third position Z3.

Further, when the cam member 60 is slid in the −X direction, the contact portion 53 can be guided by the third adjustment surface 62*c* and can be brought into contact with the fourth maintenance surface 61*d* as illustrated in FIG. 6. At this time, the carriage 20 is displaced in the −Z direction, and the carriage 20 is located at the fourth position Z4. The gap is the smallest when the carriage 20 is located at the fourth position Z4, and the gap is the largest when the carriage 20 is located at the first position Z1.

As described above, the gap adjustment unit 40 is configured to change a gap when the cam member 60 slides in the width direction (the X-axis direction) with respect to the carriage 20 and the sliding member 50.

In the present embodiment, the gap adjustment unit 40 includes a buffer unit 70 that decreases a displacement speed of the carriage 20 in the first axis direction (the Z-axis direction) when the gap is reduced. In other words, the buffer unit 70 is provided to decrease the displacement speed of the carriage 20, which is displaced in a direction in which the recording head 10 is positioned downward in the Z-axis direction from the first position Z1 illustrated in FIG. 7.

Since the gap adjustment unit 40 includes the buffer unit 70, the displacement speed of the carriage 20 that is displaced in a direction in which the gap is reduced can be reduced, and a sound that is generated when the carriage 20 is displaced can be suppressed.

In the present embodiment, the buffer unit 70 illustrated in FIGS. 6 and 7 includes a rack and pinion mechanism constituted by a rack 71 and a pinion gear 72. The rack 71 constituting the rack and pinion mechanism is provided in the sliding member 50 such that teeth are arranged in the first axis direction. The rack 71 has a lower end attached to the sliding member 50.

The pinion gear 72 constituting the rack and pinion mechanism is provided in the carriage 20. The buffer unit 70 is configured to reduce the displacement speed of the carriage 20 by applying resistance when the pinion gear 72 rotates.

Since the buffer unit 70 is configured in this manner, a structure of the buffer unit 70 can be simplified, and costs thereof can be reduced.

In the present embodiment, the buffer unit 70 is configured to impart resistance to the pinion gear 72 by a damper 73. That is, the pinion gear 72 is configured as a gear damper including the damper 73. By using the damper 73, a simple configuration in which rotational resistance is applied to the pinion gear 72 can be achieved.

Further, the buffer unit 70 acts on the carriage 20 that is displaced in a direction including a vertical downward component, that is, the −Z direction, in the Z-axis direction that is the first axis direction, and does not act on the carriage 20 that is displaced in the direction including the vertical upward component, that is, the +Z direction, in the Z-axis direction.

In more detail, the pinion gear 72 is provided with a one-way clutch that is not illustrated. When the carriage 20 is displaced in the −Z direction, the pinion gear 72 rotates in a counterclockwise direction when FIGS. 6 and 7 is viewed from the front side, and a buffering action by the damper 73 acts on the carriage 20. In contrast, when the carriage 20 is displaced in the +Z direction, the pinion gear 72 is idled by the one-way clutch, and the buffering action by the damper 73 does not act on the carriage 20.

With this configuration, when the carriage 20 is displaced downward, the carriage 20 is decelerated by the buffer unit 70, and a possibility that the carriage 20 is vigorously displaced by a self-weight thereof to make a loud sound can be reduced. On the other hand, since the buffer unit 70 does not act when the carriage 20 is displaced upward, an increase in load when the carriage 20 is displaced upward can be suppressed.

Embodiment 2

In Embodiment 2, a gap adjustment unit 40A including a buffer unit 70A having a configuration that is different from that of Embodiment 1 will be described with reference to FIGS. 9 and 10. Description will be made also with reference to FIG. 8 used in the description of Embodiment 1.

In the following embodiments, the same components as those of Embodiment 1 are denoted by the same reference numerals, and description of the components will be omitted.

In FIG. 8, the buffer unit 70A acts when the gap G changes from a size defined by the first position Z1 to a size defined by the second position Z2, and does not act when the gap G changes from the size defined by the second position Z2 to a size defined by the third position Z3.

Figure 9:
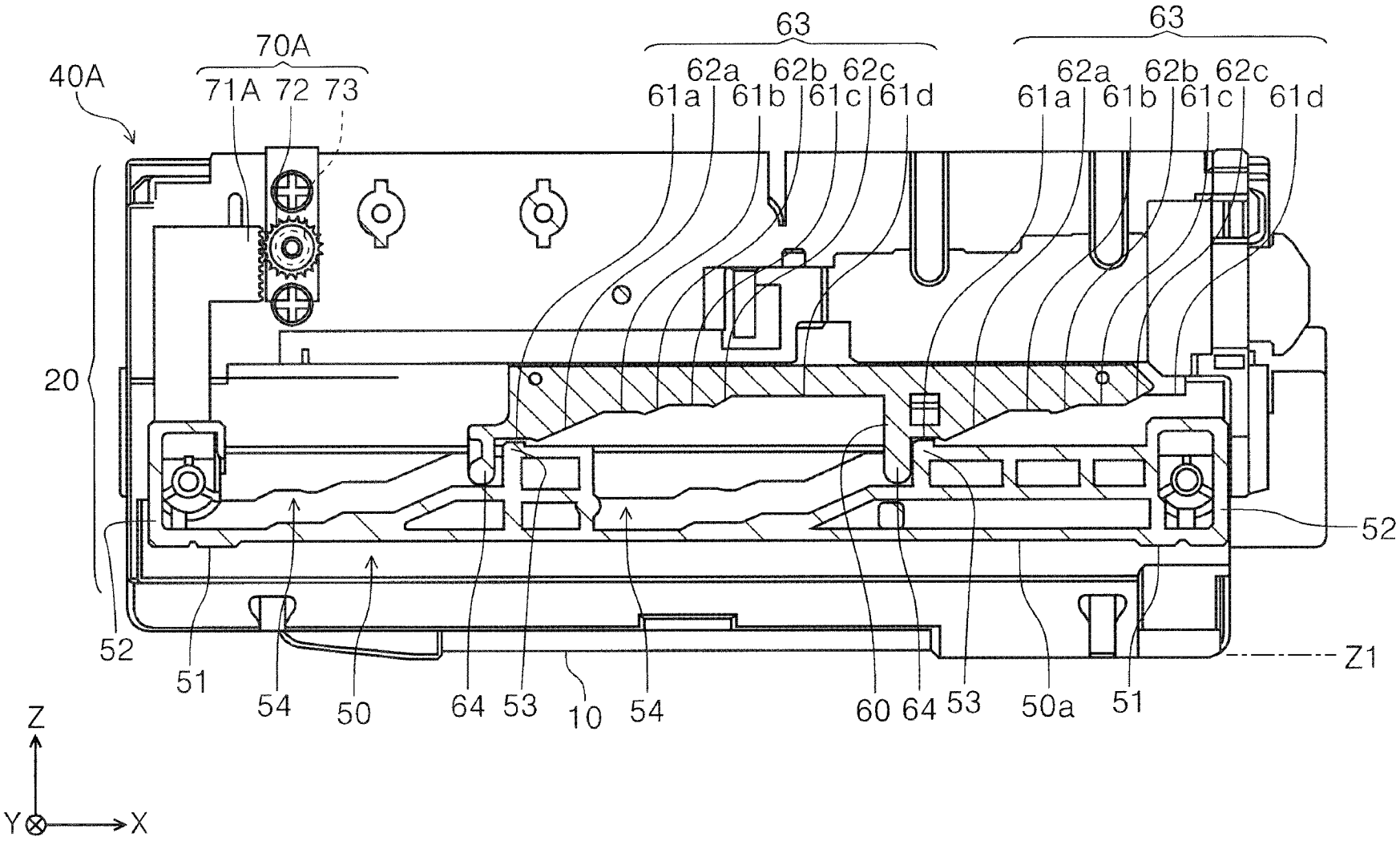
FIG. 9 is a diagram for illustrating a gap adjustment unit according to Embodiment 2.
Figure 10:
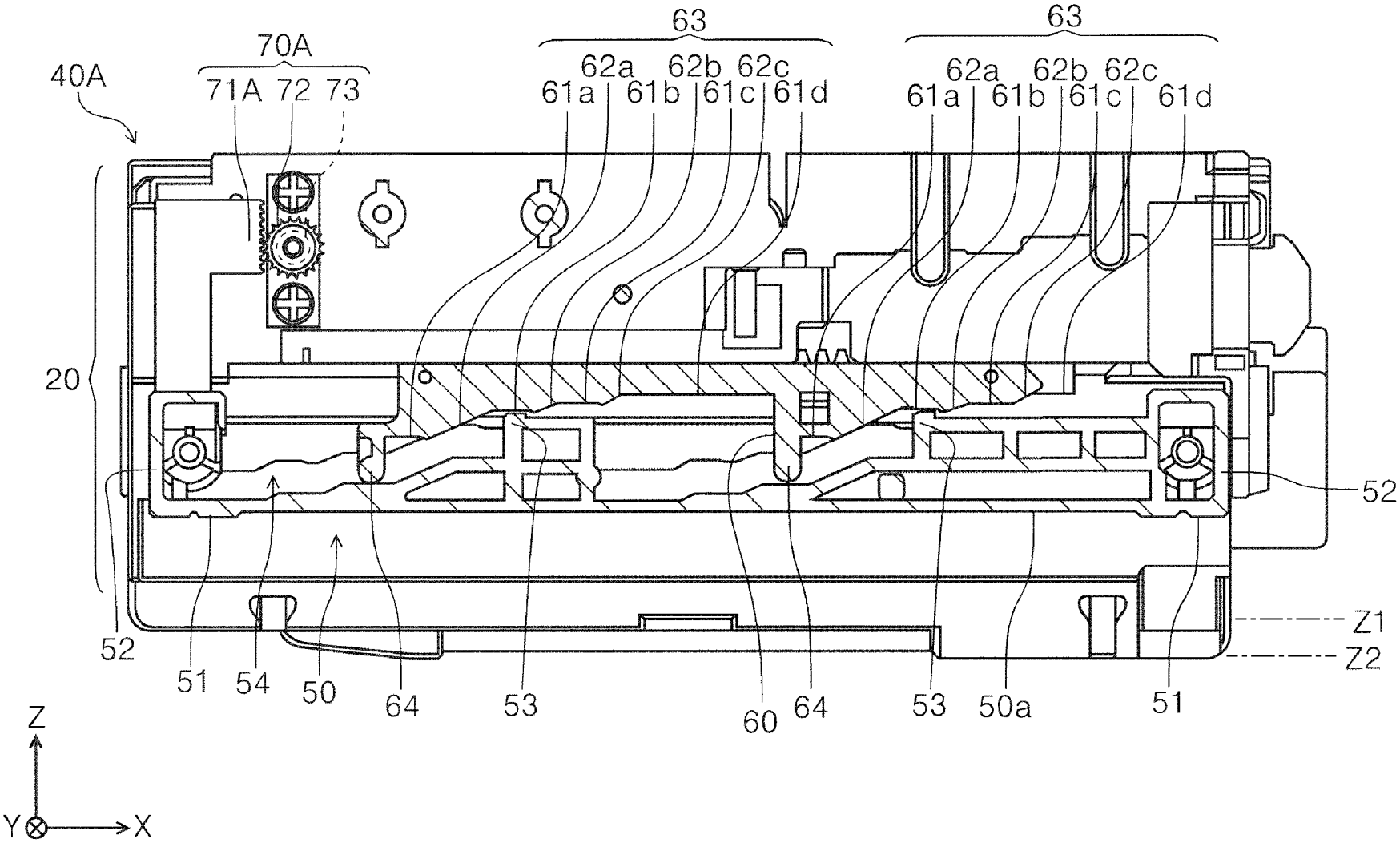
FIG. 10 is a diagram for illustrating the gap adjustment unit according to Embodiment 2.

In more detail, the buffer unit 70A illustrated in FIGS. 9 and 10 includes a rack and pinion mechanism constituted by a rack 71A and a pinion gear 72. Similar to the buffer unit 70 of Embodiment 1, the pinion gear 72 is provided in the carriage 20, and is configured to reduce the displacement speed of the carriage 20 by imparting resistance when the pinion gear 72 rotates. The pinion gear 72 is provided with the damper 73.

The rack 71A has teeth arranged in the first axis direction (the Z-axis direction) and is provided on the sliding member 50. The rack 71A is provided with teeth to engage with the pinion gear 72 from a state in which the contact portion 53 of the sliding member 50 is in contact with the first maintenance surface 61*a* of the stepped portion 63 as illustrated in FIG. 9 to a state in which the contact portion 53 of the sliding member 50 is in contact with the second maintenance surface 61*b* of the stepped portion 63 as illustrated in FIG. 10. That is, when the carriage 20 is displaced from the first position Z1 (see FIG. 9) to the second position Z2 (see FIG. 10), the rack 71A and the pinion gear 72 engage with each other. Thereafter, when the contact portion 53 of the sliding member 50 comes into contact with the fourth maintenance surface 61*d* through the third maintenance surface 61*c* from the second maintenance surface 61*b*, the pinion gear 72 is disengaged from the rack 71A.

As illustrated in FIG. 8, the height difference L1 between the first maintenance surface 61*a* and the second maintenance surface 61*b* is larger than the height difference L2 between the second maintenance surface 61*b* and the third maintenance surface 61*c* and the height difference L3 between the third maintenance surface 61*c* and the fourth maintenance surface 61*d*. Therefore, when the carriage 20 is displaced from the first position Z1 to the second position Z2, the carriage 20 is displaced most downward, and large noise is likely to be generated. According to the present embodiment, only when a large sound is likely to be generated since the carriage 20 is displaced greatly downward, the buffer unit 70A can act on the carriage 20, so that generation of sound due to the displacement of the carriage 20 can be effectively suppressed.

Embodiment 3

In Embodiment 3, a gap adjustment unit 40B including a buffer unit 70B will be described with reference to FIG. 11.

Figure 11:
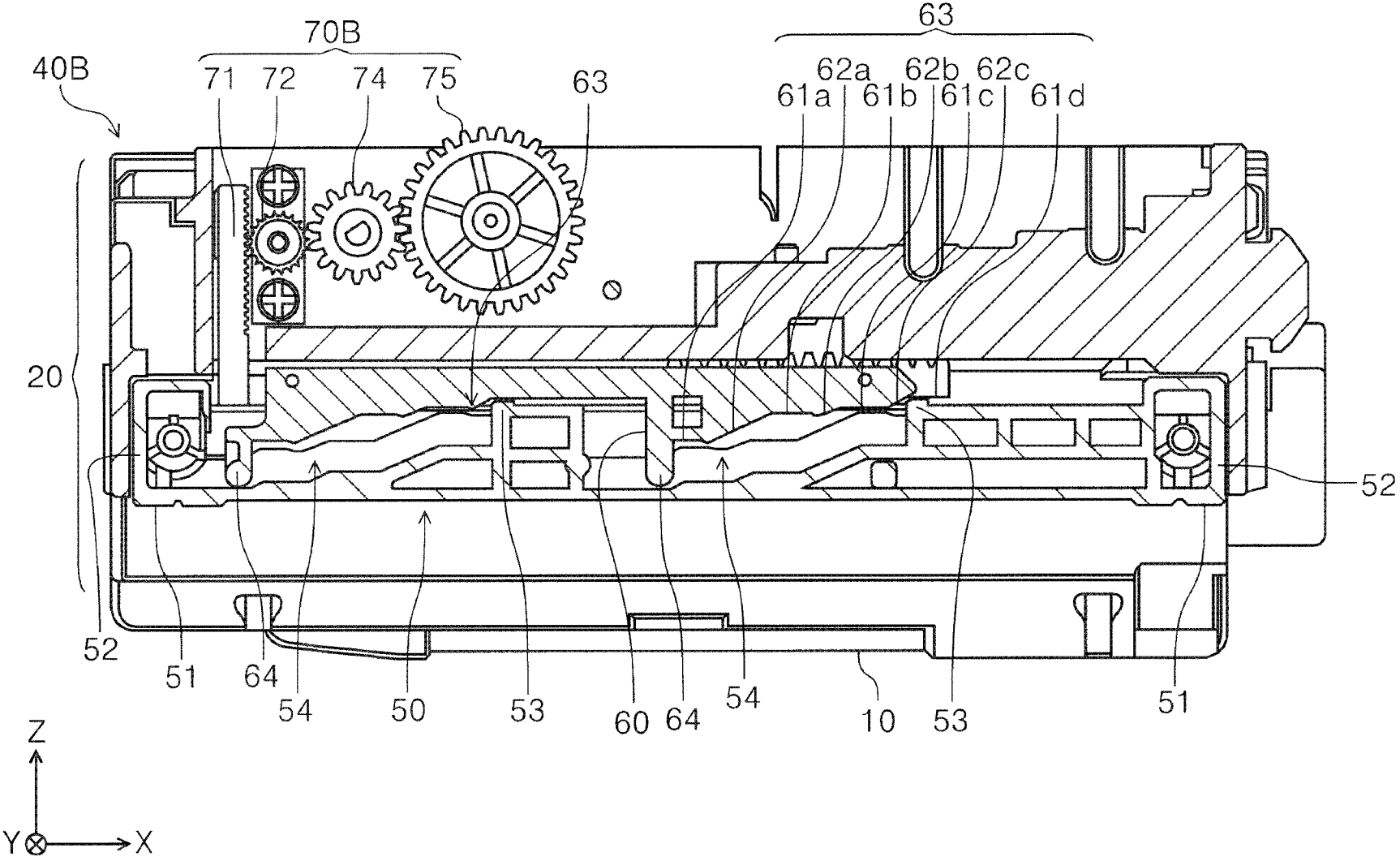
FIG. 11 is a diagram for illustrating a gap adjustment unit according to Embodiment 3.

The buffer unit 70B illustrated in FIG. 11 includes a first driven gear 74 as a driven gear that engages with the pinion gear 72 and is driven to rotate. The first driven gear 74 is a gear having a larger number of teeth than that of the pinion gear 72, and a reduction gear ratio when power is transmitted from the pinion gear 72 to the first driven gear 74 is larger than 1. Similarly, the buffer unit 70B includes a second driven gear 75 that engages with the first driven gear 74 and is driven to rotate. The second driven gear 75 is a gear having a larger number of teeth than that of the first driven gear 74, and a reduction gear ratio when power is transmitted from the first driven gear 74 to the second driven gear 75 is larger than 1. Thus, a reduction gear ratio when power is transmitted from the pinion gear 72 to the second driven gear 75 is larger than 1. As a result, the pinion gear 72 is configured to receive resistance during rotation.

In the present embodiment, by using the buffer unit 70B having the above-described configuration, a configuration can be simply achieved that rotational resistance is applied to the pinion gear 72.

Embodiment 4

In Embodiment 4, a gap adjustment unit 40C including a buffer unit 70C will be described with reference to FIG. 12.

Figure 12:
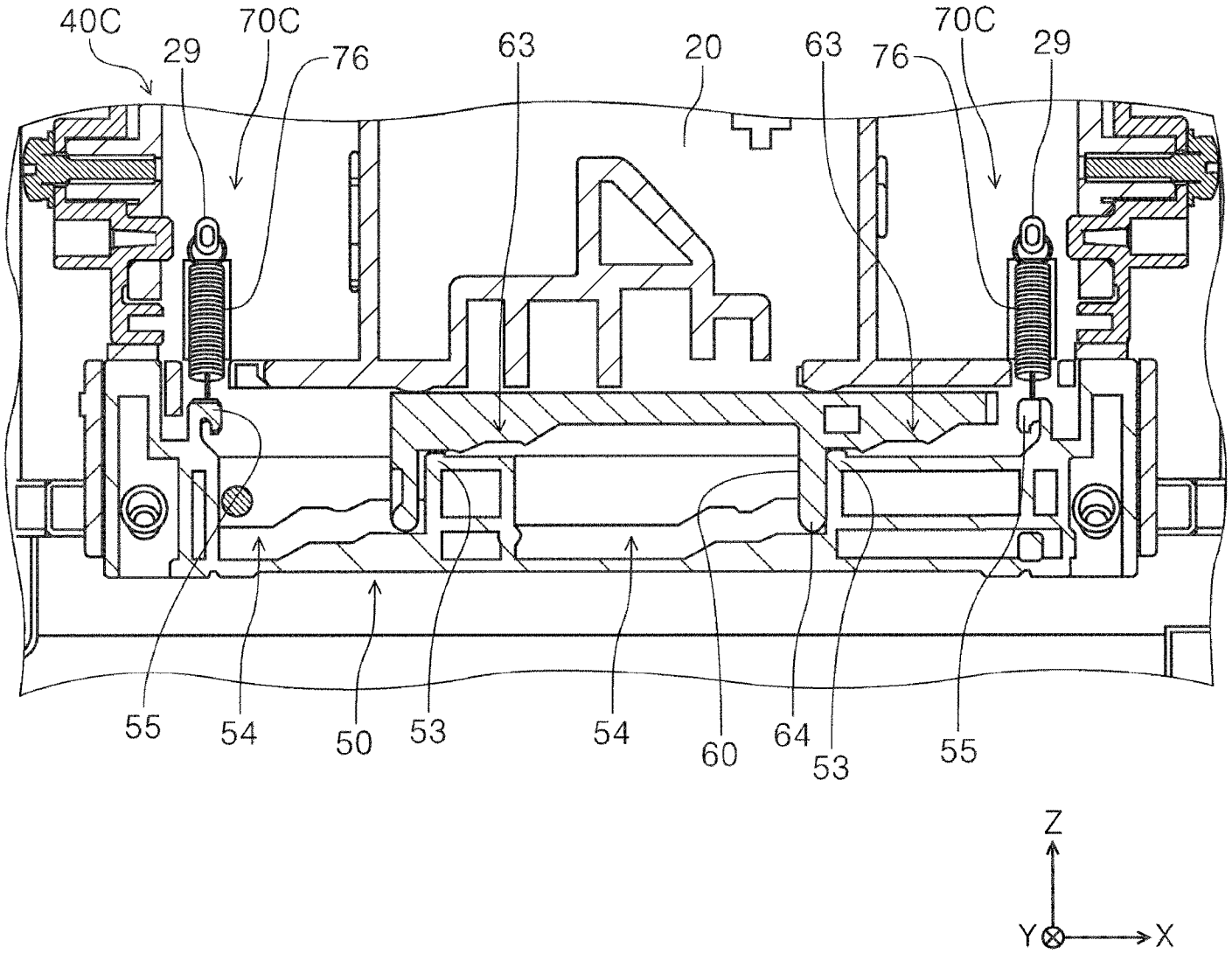
FIG. 12 is a diagram for illustrating a gap adjustment unit according to Embodiment 4.

The buffer unit 70C illustrated in FIG. 12 includes a spring member 76 as an elastic member, which is provided between the sliding member 50 and the carriage 20, and the displacement speed of the carriage 20 is reduced by elasticity of the spring member 76.

The spring member 76 is a tension spring provided between a first hook 55 provided in the sliding member 50 and a second hook 29 provided in the carriage 20. Since the carriage 20 is displaced downward against a spring force of the spring member 76, the displacement speed of the carriage 20 to the lower side can be reduced, and generation of a sound at this time can be suppressed.

Embodiment 5

Figure 13:
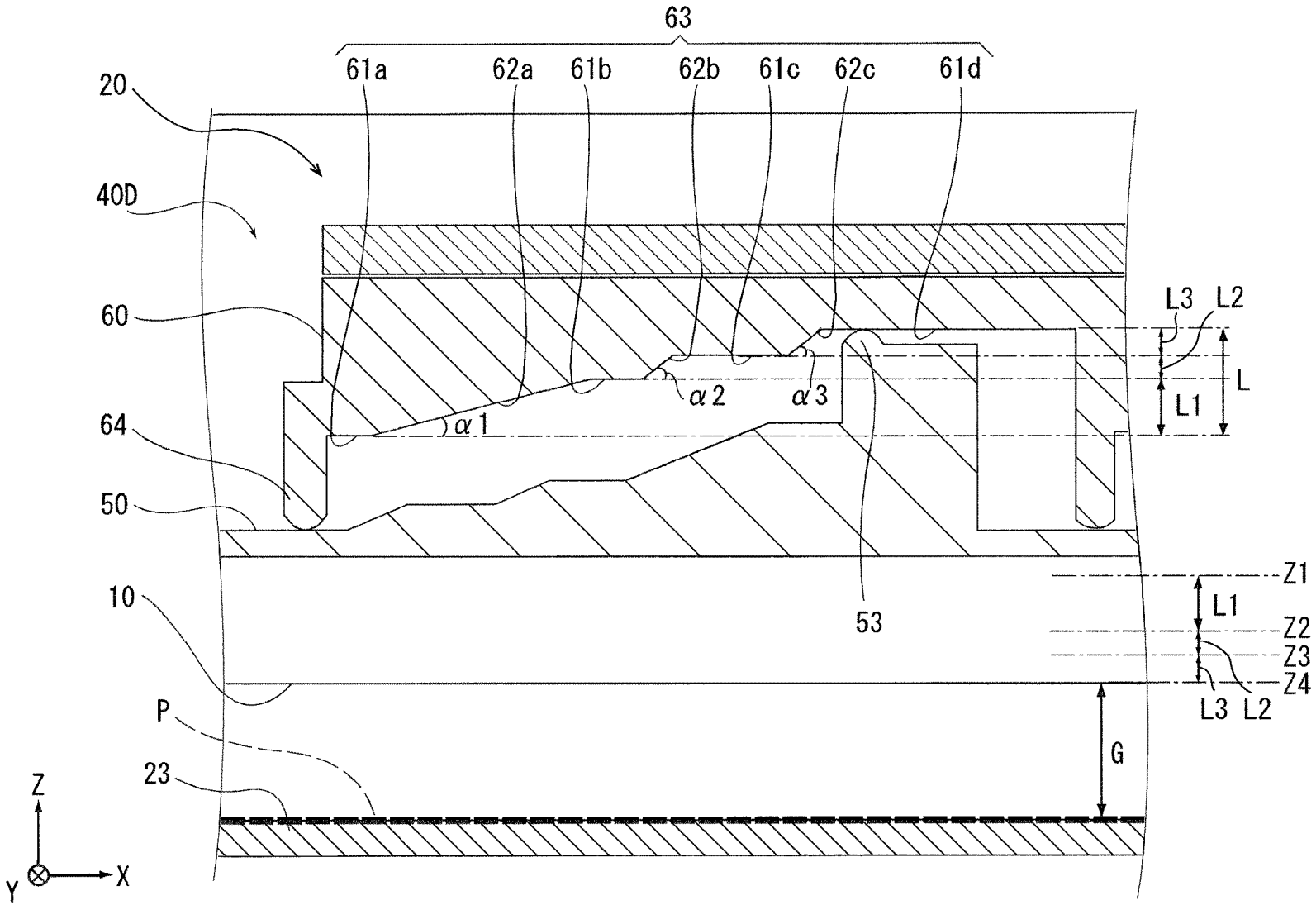
FIG. 13 is a diagram for illustrating a gap adjustment unit according to Embodiment 5.

In Embodiment 5, a gap adjustment unit 40D will be described with reference to FIG. 13.

In the gap adjustment unit 40D, similar to the cam member 60 of Embodiment 1, the stepped portion 63 of the cam member 60 has, as the maintenance surfaces 61, the first maintenance surface 61*a*, the second maintenance surface 61*b*, the third maintenance surface 61*c*, and the fourth maintenance surface 61*d*. The height difference L1 between the first position Z1 and the second position Z2 in the first axis direction (the Z-axis direction) is larger than the height difference L2 between the second position Z2 and the third position Z3 in the first axis direction. An inclination angle $\alpha 1$ of the first adjustment surface 62*a* coupling the first maintenance surface 61*a* and the second maintenance surface 61*b* with respect to a horizontal plane is larger than an inclination angle $\alpha 2$ of the second adjustment surface 62*b* coupling the second maintenance surface 61*b* and the third maintenance surface 61*c* with respect to the horizontal plane. In the present embodiment, the inclination angle $\alpha 1$ is smaller than an inclination angle $\alpha 3$ of the third adjustment surface 62*c* coupling the third maintenance surface 61*c* and the fourth maintenance surface 61*d* with respect to the horizontal plane. Further, the inclination angle $\alpha 2$ and the inclination angle $\alpha 3$ are set to the same angle.

In the stepped portion 63, since the inclination angle $\alpha 1$ of the first adjustment surface 62*a* used when the carriage 20 is displaced in the Z-axis direction by L1 is smaller than the inclination angle α2 of the second adjustment surface 62*b* used when the carriage 20 is displaced by L2 that is smaller than L1, an inclination of the first adjustment surface 62*a* used when the carriage 20 is displaced more greatly can be made gentle, and a sound generated when the carriage 20 is displaced can be reduced. In the present embodiment, the buffer unit for reducing the displacement speed of the carriage 20 to the lower side can be omitted.

Embodiment 6

Figure 20:
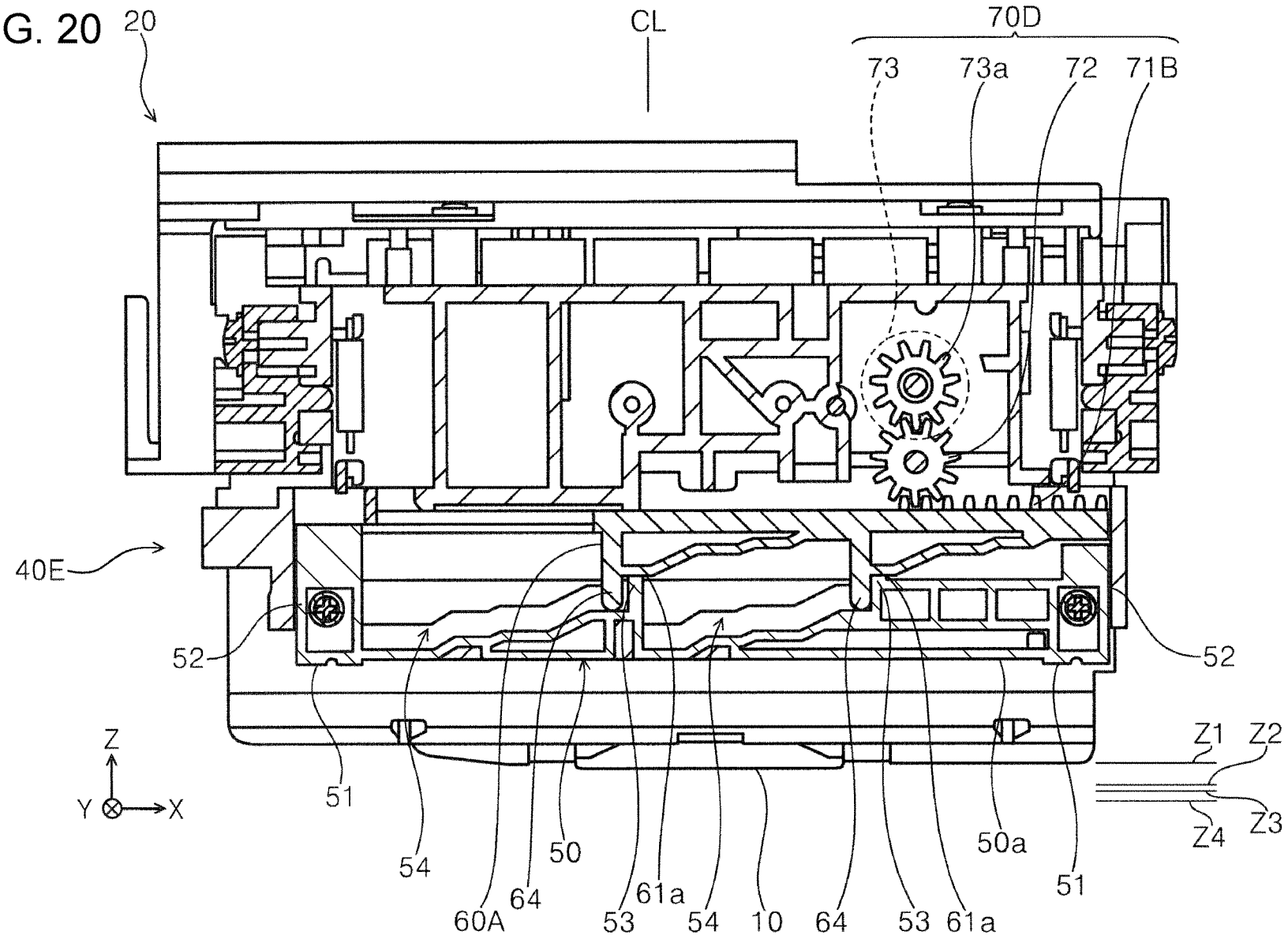
FIG. 20 is a diagram for illustrating a gap adjustment unit according to Embodiment 6.
Figure 21:
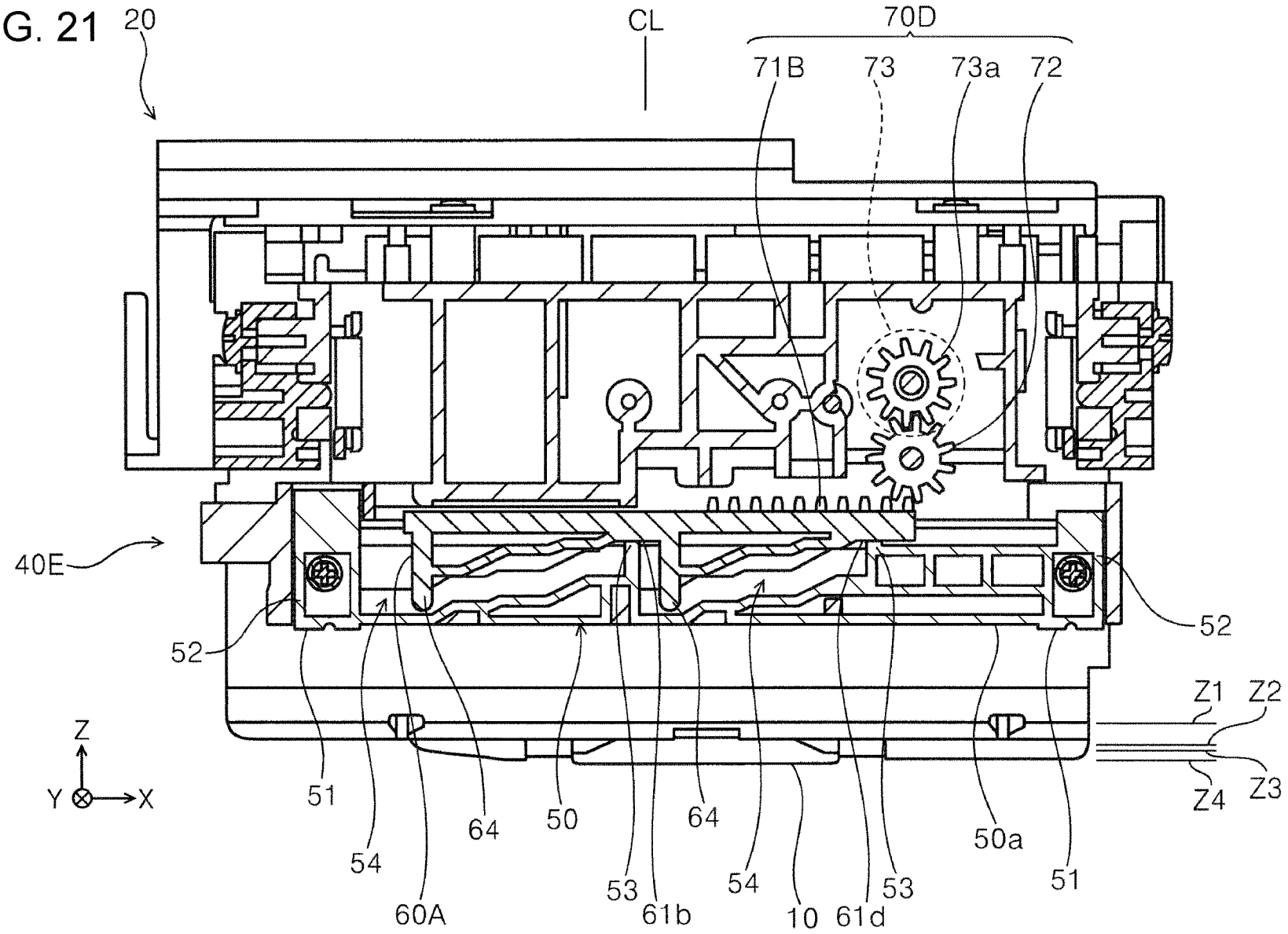
FIG. 21 is a diagram for illustrating the gap adjustment unit according to Embodiment 6.

In Embodiment 6, a gap adjustment unit 40E including the buffer unit 70D will be described with reference to FIGS. 20 and 21. A cam member 60A provided in the gap adjustment unit 40E has the same configuration except that a rack 71B is integrally provided as compared to the cam member 60 described in Embodiment 1. In FIGS. 20 and 21, in order to avoid complication of the drawing, reference numerals of the adjustment surface 62 illustrated in Embodiment 1 will be omitted, and only necessary reference numerals will be illustrated for the maintenance surface 61.

FIG. 20 illustrates a state in which the position of the carriage 20 is in the first position Z1 where the gap G (see FIG. 8) is the largest, and FIG. 21 illustrates a state in which the position of the carriage 20 is in the fourth position Z4 where the gap G (see FIG. 8) is the smallest.

In FIGS. 20 and 21, the buffer unit 70D includes a rack and pinion mechanism including the rack 71B and the pinion gear 72. Unlike Embodiment 1, the rack 71B constituting the rack and pinion mechanism is provided integrally with the cam member 60A such that teeth are arranged in the X-axis direction.

The pinion gear 72 constituting the rack and pinion mechanism is provided in the carriage 20. The pinion gear 72 engages with the damper gear 73*a*. The damper gear 73*a* is a gear provided integrally with the damper 73.

With this configuration, the displacement speed of the carriage 20 to which resistance is applied when the pinion gear 72 rotates is reduced.

Further, in contrast to Embodiment 1, in the present embodiment, the length of the rack 71B can be increased, and the amount of rotation of the pinion gear 72 can be further ensured. Therefore, influence of a backlash in meshing of gears can be reduced, and the sound generated when the carriage 20 is displaced can be suppressed more reliably.

Further, in the present embodiment, the buffer unit 70D is provided in the carriage 20 in a direction opposite to the home position. In FIGS. 20 and 21, a position CL is a central position of the carriage 20 in the X-axis direction, the −X direction is a direction of the home position of the carriage 20 and the +X direction is a direction that is opposite to the direction of the home position. The buffer unit 70D is provided in the +X direction with respect to the position CL.

Here, when the buffer unit 70D is hypothetically provided in the −X direction with respect to the position CL, the pinion gear 72 is disengaged from the rack 71B when the cam member 60A is displaced in the +X direction. Thus, the cam member 60A needs to be extended in the −X direction, and the apparatus becomes large. The cam member 60A is displaced from a central area of the carriage 20 as illustrated in FIG. 21 to an area of the carriage 20 in the +X direction as illustrated in FIG. 20 and is displaced in an opposite direction thereto. That is, the cam member 60A is displaced in an area in the +X direction with respect to the central position CL of the carriage 20 in the X-axis direction.

However, as described above, since the buffer unit 70D is provided in the carriage 20 in the direction opposite to the home position, an increase in the size of the apparatus can be suppressed.

Even in such a buffer unit 70D, when the one-way clutch is provided, it can be configured such that a buffering action is generated on the carriage 20 that displaces in a direction including a vertical downward component, that is, the −Z direction, in the Z-axis direction that is the first axis direction, and that the buffering action is not generated on the carriage 20 that displaces in the direction including the vertical upward component, that is, the +Z direction, in the Z-axis direction.

Modification Example of Gap Adjustment Unit

Figure 14:
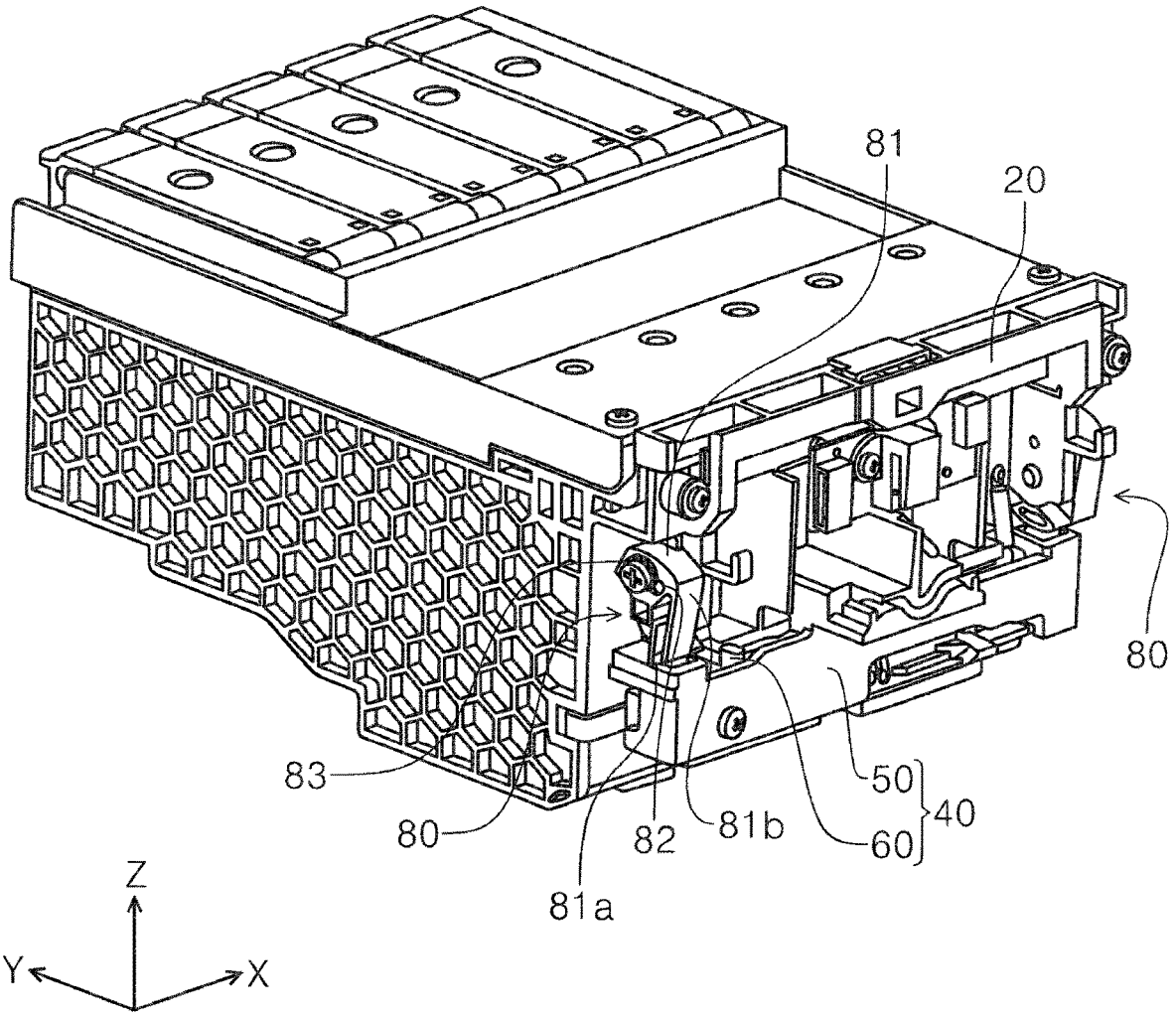
FIG. 14 is a perspective view illustrating a carriage including the gap adjustment unit having an auxiliary adjustment unit.

A modification example of the gap adjustment unit 40 will be described with reference to FIGS. 14 to 17. The gap adjustment unit 40 can be provided with auxiliary adjustment units 80. As illustrated in FIG. 14, the auxiliary adjustment units 80 are provided on the carriage 20, and are arranged on both sides in the width direction on the upper side of the sliding member 50.

Figure 15:
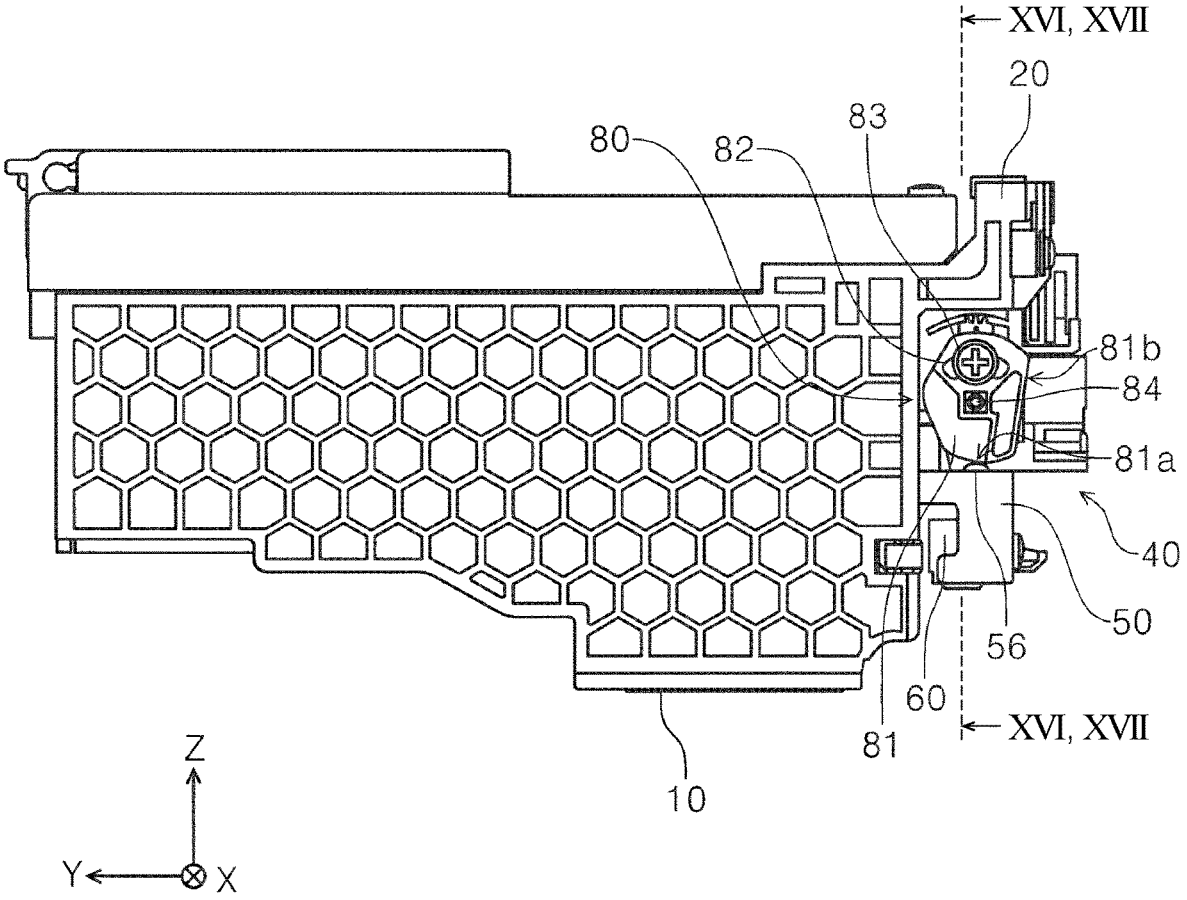
FIG. 15 is a side view of the carriage illustrated in FIG. 14.

As illustrated in FIG. 15, the auxiliary adjustment unit 80 includes a cam 81 that can pivot about a shaft portion 84 provided in the carriage 20. An abutting portion 56 on which the cam 81 can abut is provided at the upper portion of the sliding member 50.

The cam 81 includes an arc-shaped portion 81*a* and a flat-shaped portion 81*b*. The arc-shaped portion 81*a* is a portion that is in contact with the abutting portion 56 in FIG. 15, and is formed in a shape along a circular arc with the shaft portion 84 as a center. The flat-shaped portion 81*b* is formed in a flat shape corresponding to a string obtained by cutting a part of a circle with the shaft portion 84 as a center. Since a distance from the shaft portion 84 to the flat-shaped portion 81*b* is shorter than a distance from the shaft portion 84 to the arc-shaped portion 81*a*, the cam 81 is pivoted to switch between a state (see FIG. 15) in which the arc-shaped portion 81*a* abuts on the abutting portion 56 of the sliding member 50 and a state (not illustrated) in which the flat-shaped portion 81*b* abuts on the abutting portion 56 of the sliding member 50, so that a relative position of the carriage 20 with respect to the sliding member 50 can be changed.

As illustrated in FIG. 15, the cam 81 includes a regulation groove 82 provided along a pivot direction of the cam 81, and a screw 83 is attached to the carriage 20 while being inserted into the regulation groove 82. With this configuration, the pivot of the cam 81 is regulated within a range in which the screw 83 is guided by the regulation groove 82.

Further, the auxiliary adjustment unit 80 can be adjusted when the carriage 20 is located at the fourth position Z4, that is, only when the carriage 20 is located at the lowermost adjustment position by the gap adjustment unit 40.

Figure 16:
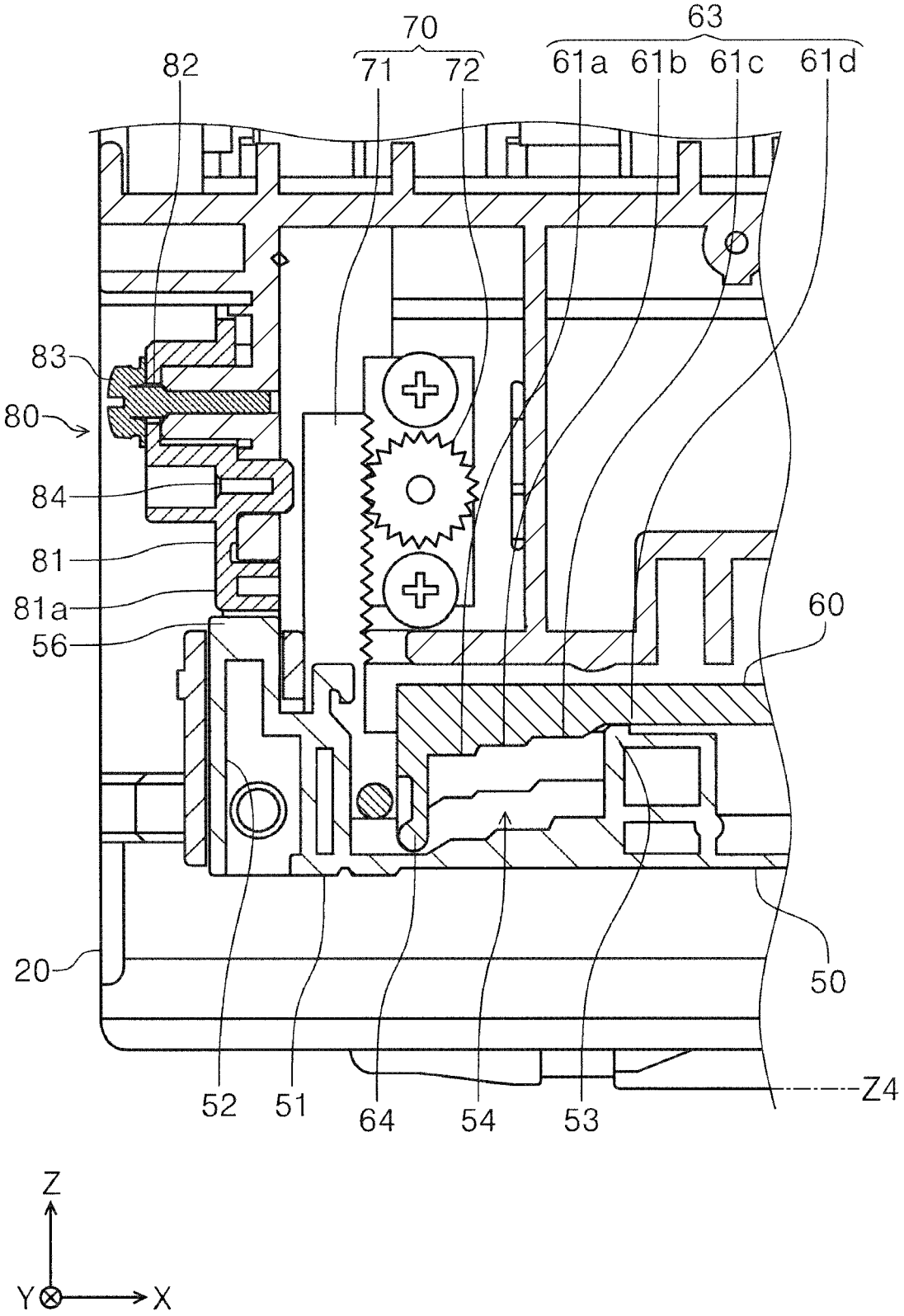
FIG. 16 is a cross-sectional view taken along line XVI-XVI in FIG. 15, and is a view illustrating a state in which the carriage is located in a fourth position in a Z-axis direction.

In detail, as illustrated in FIG. 16, when the contact portion 53 provided in the sliding member 50 comes into contact with the fourth maintenance surface 61*d* of the stepped portion 63 of the cam member 60 so that the carriage 20 is located at the fourth position Z4, the cam 81 of the auxiliary adjustment unit 80 can come into contact with the abutting portion 56 at the upper portion of the sliding member 50. When the contact portion 53 comes into contact with another maintenance surface 61, that is, the first maintenance surface 61*a*, the second maintenance surface 61*b*, and the third maintenance surface 61*c* so that the carriage 20 is located at the first position Z1 to the third position Z3, the cam 81 is not in contact with the abutting portion 56 at the upper portion of the sliding member 50.

Figure 17:
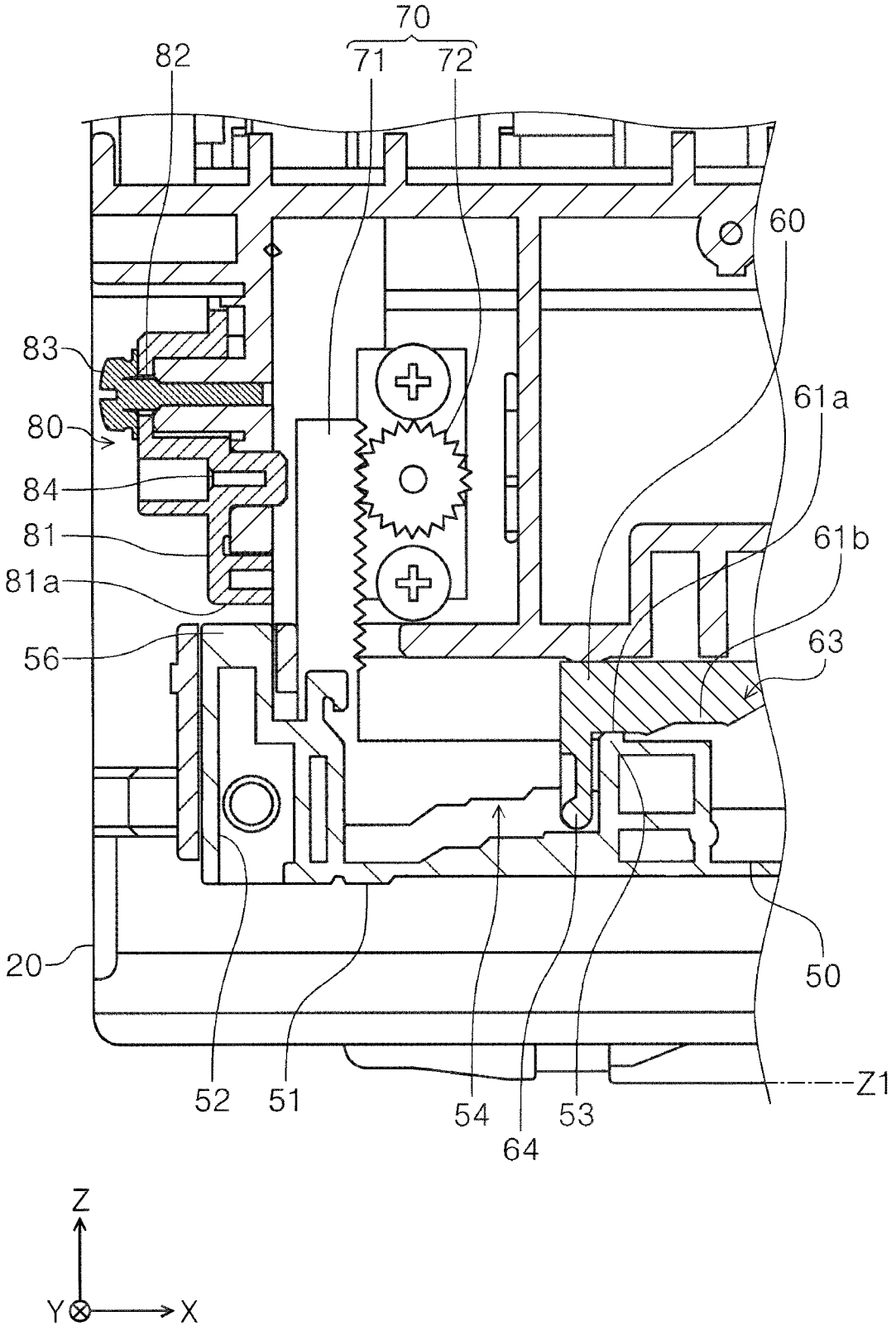
FIG. 17 is a cross-sectional view taken along line XVII-XVII in FIG. 15, and is a view illustrating a state in which the carriage is located in a first position in a Z-axis direction.

FIG. 17 illustrates a state in which the contact portion 53 is in contact with the fourth maintenance surface 61*d* and the carriage 20 is located at the fourth position Z4. At this time, the cam 81 is separated from the abutting portion 56.

With the above configuration, in a state in which the carriage 20 is located at the fourth position Z4, fine adjustment in the Z-axis direction can be performed by the auxiliary adjustment unit 80.

The auxiliary adjustment unit 80 may be provided in the gap adjustment units 40A to 40E described in Embodiment 2 to Embodiment 6.

Another Example of Unit for Adjusting Position of Carriage

Figure 18:
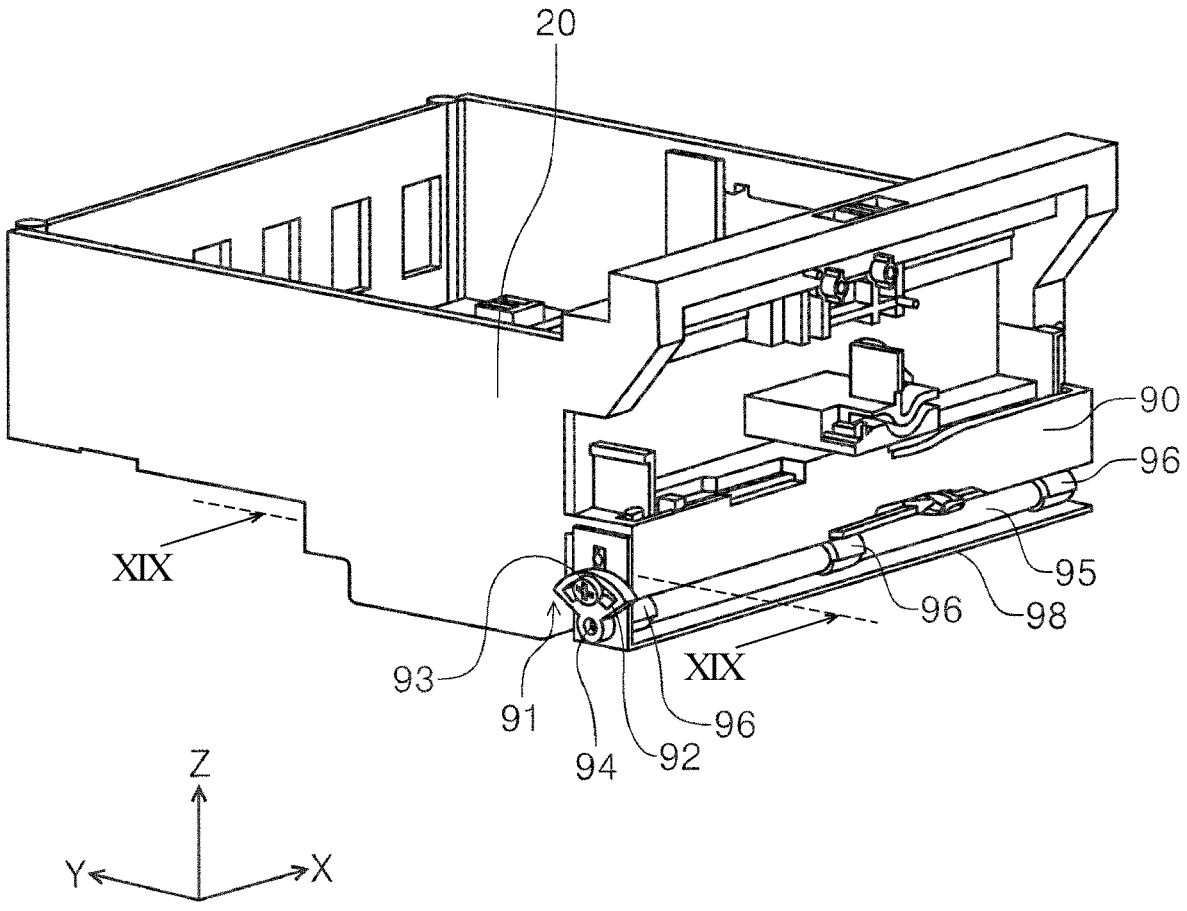
FIG. 18 is a perspective view for illustrating another gap adjustment unit.
Figure 19:
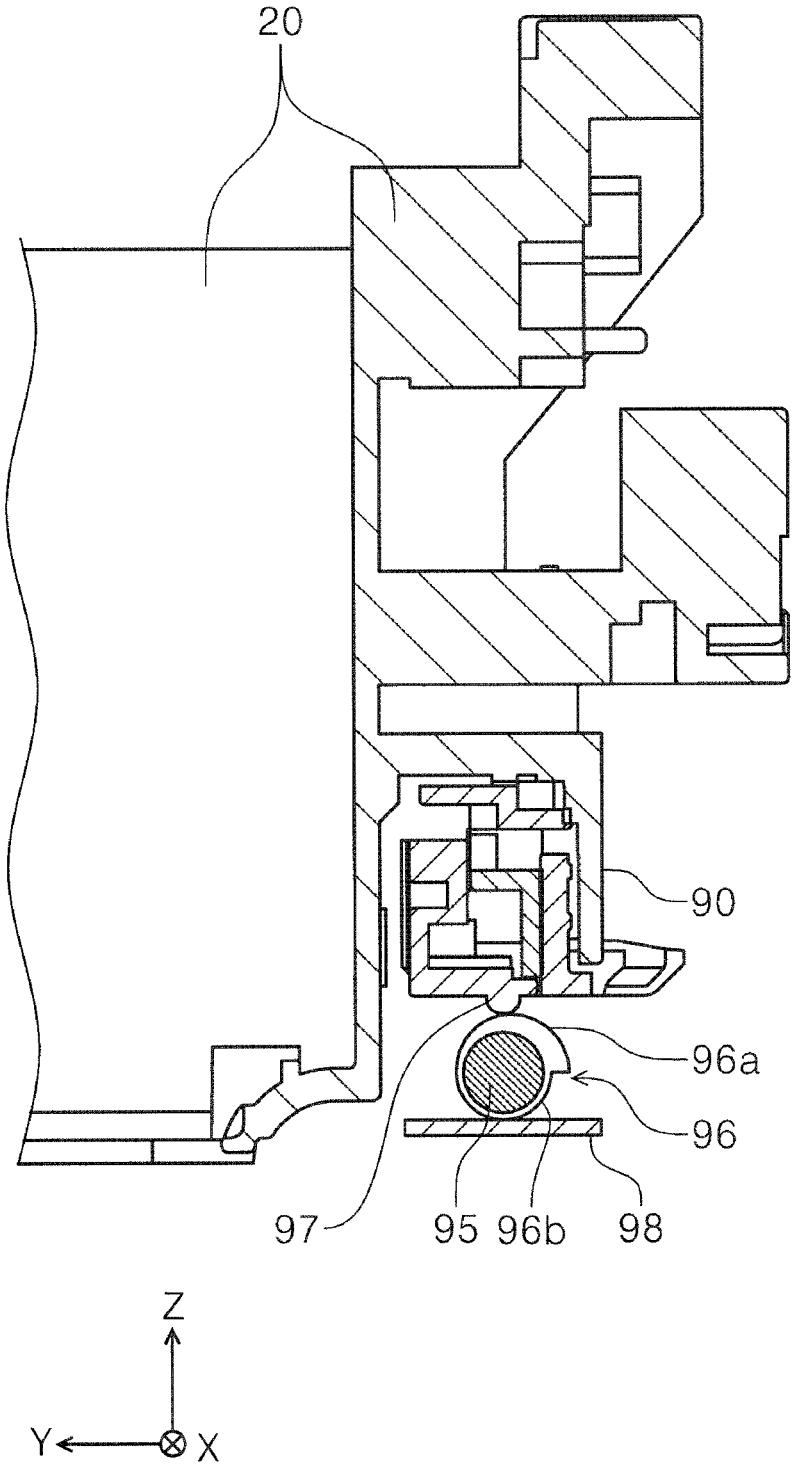
FIG. 19 is a sectional view taken along line XIX-XIX in FIG. 18.

The position of the carriage 20 in the first axis direction (the Z-axis direction) can also be adjusted by a configuration illustrated in FIGS. 18 and 19. A sliding member 90 that moves in the width direction integrally with the carriage 20 while sliding against the guide member 28 (see FIG. 3) is fixed to the carriage 20 illustrated in FIGS. 18 and 19. That is, a relative position between the carriage 20 and the sliding member 90 is not changed.

In FIG. 18, a support member 98 is provided on a side surface of the sliding member 90 in the −X direction. The support member 98 is provided with a bearing that is not illustrated, and has a shaft 95 pivotably attached thereto to extend in the X-axis direction which is the width direction. A pivot shaft 94 of a fan-shaped member 91 is fixed to an end portion of the shaft 95 in the −X direction. By pivoting the fan-shaped member 91, the shaft 95 can be pivoted.

The fan-shaped member 91 includes a regulation groove 92 provided along a pivot direction of the fan-shaped member 91, and a screw 93 is attached to the support member 98 while being inserted into the regulation groove 92. With this configuration, the pivot of the fan-shaped member 91 is regulated within a range in which the screw 93 is guided by the regulation groove 92.

The shaft 95 is provided with an eccentric cam 96 illustrated in FIG. 19. The eccentric cam 96 includes a thick portion 96*a* that is thick with respect to the shaft 95 and a thin portion 96*b* that is thin with respect to the shaft 95. An abutting portion 97 that can contact the eccentric cam 96 is provided at a lower portion of the sliding member 90.

When the fan-shaped member 91 pivots, the shaft 95 pivots, so that the position of the eccentric cam 96 that is in contact with the abutting portion 97 of the sliding member 90 is switched between the thick portion 96*a* and the thin portion 96*b*. Thus, the height of the carriage 20 can be changed.

What is claimed is:

1. A recording apparatus comprising:

a recording head that performs recording on a medium that is transported;

a carriage that has the recording head mounted thereon and is movable in a width direction intersecting a transport direction of the medium;

a guide member that extends in the width direction and guides the carriage; and a gap adjustment unit that displaces the carriage in a first axis direction to change a gap between the recording head and a support surface, wherein the gap adjustment unit has a sliding member that moves in the width direction integrally with the carriage while the sliding member slides with respect to the guide member, and a cam member that is interposed between the carriage and the sliding member and has a stepped portion in which a maintenance surface that maintains a position of the carriage in the first axis direction and an adjustment surface that changes the position of the carriage in the first axis direction are alternately arranged in the width direction, the gap adjustment unit is configured such that the cam member slides in the width direction with respect to the carriage and the sliding member to change the gap, the stepped portion includes, as the maintenance surface, a first maintenance surface that maintains a position of the carriage with respect to the sliding member at a first position, a second maintenance surface that maintains the position of the carriage with respect to the sliding member at a second position at which the gap is smaller than the gap at the first position, and a third maintenance surface that maintains the position of the carriage with respect to the sliding member at a third position at which the gap is smaller than the gap at the second position, a height difference between the first position and the second position in the first axis direction is larger than a height difference between the second position and the third position in the first axis direction, wherein a height of the third maintenance surface is higher in the first axis direction than a height of the first maintenance surface, the stepped portion includes, as the adjustment surface, a first adjustment surface that couples the first maintenance surface and the second maintenance surface and a second adjustment surface that couples the second maintenance surface and the third maintenance surface, and an inclination angle of the first adjustment surface with respect to a horizontal plane is smaller than an inclination angle of the second adjustment surface with respect to the horizontal plane.

2. The recording apparatus according to claim 1, wherein the gap adjustment unit includes a buffer unit that decreases a displacement speed of the carriage in the first axis direction when the gap is reduced.

3. The recording apparatus according to claim 2, wherein the buffer unit acts when the gap is changed from a size defined at the first position to a size defined at the second position, and does not act when the gap is changed from the size defined at the second position to a size defined at the third position.

4. The recording apparatus according to claim 2, wherein the buffer unit includes a rack and pinion mechanism, a rack constituting the rack and pinion mechanism is provided on the sliding member along the first axis direction, a pinion gear constituting the rack and pinion mechanism is provided on the carriage, and resistance is applied to the pinion gear upon rotation, and a displacement speed of the carriage is reduced.

5. The recording apparatus according to claim 4, wherein the buffer unit is configured to apply the resistance to the pinion gear by a damper.

6. The recording apparatus according to claim 4, wherein the buffer unit includes a driven gear that engages with the pinion gear and is driven to rotate, and a reduction gear ratio when power is transmitted from the pinion gear to the driven gear is larger than 1, and the driven gear applies the resistance to the pinion gear.

7. The recording apparatus according to claim 2, wherein the buffer unit includes an elastic member provided between the sliding member and the carriage, and the displacement speed of the carriage is reduced by elasticity of the elastic member.

8. The recording apparatus according to claim 2, wherein the buffer unit includes a rack and pinion mechanism, a rack constituting the rack and pinion mechanism is provided in the cam member along the width direction, a pinion gear constituting the rack and pinion mechanism is provided on the carriage, and resistance is applied to the pinion gear upon rotation, and the displacement speed of the carriage is reduced.

9. The recording apparatus according to claim 8, wherein the cam member displaces in an area in a direction opposite to a direction of a home position of the carriage with respect to a central position of the carriage in the width direction, and the buffer unit is provided in the direction opposite to the direction of the home position of the carriage with respect to the central position of the carriage in the width direction.

10. The recording apparatus according to claim 1, wherein the first position is a position at which the gap is largest.

* * * * *